US012751531B2

(12) United States Patent
Hickey et al.

(10) Patent No.: US 12,751,531 B2
(45) Date of Patent: Oct. 6, 2026

(54) HAIRSTYLING DEVICE

(71) Applicant: Dyson Technology Limited, Wiltshire (GB)

(72) Inventors: Elizabeth Chania Hickey, Bristol (GB); Andrew Collingwood Watson, Gloucester (GB); Lili Tao, Bristol (GB)

(73) Assignee: Dyson Technology Limited, Malmesbury (GB)

( * ) Notice: Subject to any disclaimer, the term of this patent is extended or adjusted under 35 U.S.C. 154(b) by 801 days.

(21) Appl. No.: 18/017,640

(22) PCT Filed: Jul. 21, 2021

(86) PCT No.: PCT/GB2021/051875
§ 371 (c)(1),
(2) Date: Jan. 23, 2023

(87) PCT Pub. No.: WO2022/023710
PCT Pub. Date: Feb. 3, 2022

(65) Prior Publication Data

US 2024/0008616 A1 Jan. 11, 2024

(30) Foreign Application Priority Data

Jul. 29, 2020 (GB) ..... 2011770

(51) Int. Cl.
*A45D 1/28* (2006.01)
*A45D 1/04* (2006.01)

(52) U.S. Cl.
CPC ..... *A45D 1/28* (2013.01); *A45D 1/04* (2013.01)

(58) Field of Classification Search
CPC ..... A45D 1/04; A45D 1/28; A45D 2/001; A45D 7/02; A45D 2001/045; A45D 1/06; A45D 1/08
See application file for complete search history.

(56) References Cited

U.S. PATENT DOCUMENTS 3,182,667 A * 5/1965 Beste ..... A45D 1/06 132/232
4,130,955 A 12/1978 Baumgartner
(Continued)

FOREIGN PATENT DOCUMENTS

BR 102013004145 A2 10/2014
BR 102013004142 A2 11/2014
(Continued)

OTHER PUBLICATIONS

Wikipedia. Inertial Measurement Unit. https://en.wikipedia.org/w/index.php?title=Inertial_measurement_unit&oldid=962075067. Jun. 11, 2020. (Year: 2020).*
(Continued)

*Primary Examiner* — Topaz L. Elliott
(74) *Attorney, Agent, or Firm* — Tucker Ellis LLP; Michael G. Craig

(57) ABSTRACT

A hairstyling device is provided. The hairstyling device includes a heatable hair contact member having a hair-contactable surface, the hair contact member being operable to apply heat to a tress of hair via the hair-contactable surface by movement of the hair contact member along the tress of hair between a first end of the tress and a second end of the tress. The hairstyling device includes sensor equipment configured to generate sensor output indicative of current use of the hairstyling device. The hairstyling device includes a controller configured to receive the sensor output from the sensor equipment, determine, based on the sensor output, that the hair contact member is at the first end of the tress or the second end of the tress, and control the hairstyling device to perform an action based on the determining.

17 Claims, 8 Drawing Sheets

(56) References Cited

U.S. PATENT DOCUMENTS

| | | | | |
|---|---|---|---|---|
| 4,685,229 | A | 8/1987 | Moravek et al. | |
| 4,745,260 | A | 5/1988 | Albinger et al. | |
| 4,947,093 | A | 8/1990 | Dunstan et al. | |
| 7,143,002 | B2 | 11/2006 | Hirano | |
| 10,021,952 | B2 | 7/2018 | Goldman et al. | |
| 10,357,092 | B2 | 7/2019 | Kustra et al. | |
| 10,470,545 | B2 | 11/2019 | Thiebaut et al. | |
| 10,507,587 | B2 | 12/2019 | Uit De Bulten | |
| 10,596,716 | B2 | 3/2020 | Hoexum et al. | |
| 10,656,604 | B2 | 5/2020 | Godlieb | |
| 10,716,391 | B2 | 7/2020 | Balooch et al. | |
| 10,909,881 | B2 | 2/2021 | Heitmann et al. | |
| 11,464,311 | B1 * | 10/2022 | Sawyers | A45D 1/18 |
| 11,574,556 | B2 | 2/2023 | Moore et al. | |
| 2009/0126757 | A1 * | 5/2009 | Marino | A46B 9/023 15/23 |
| 2010/0078038 | A1 * | 4/2010 | Shami | A45D 1/08 132/224 |
| 2011/0253164 | A1 | 10/2011 | Morgandi et al. | |
| 2012/0211018 | A1 | 8/2012 | deGrood | |
| 2012/0227758 | A1 | 9/2012 | Ford et al. | |
| 2012/0312320 | A1 | 12/2012 | Humphreys et al. | |
| 2013/0312780 | A1 | 11/2013 | Rafaeli et al. | |
| 2015/0101139 | A1 | 4/2015 | Guy-Rab et al. | |
| 2015/0112633 | A1 | 4/2015 | Lee et al. | |
| 2015/0144610 | A1 | 5/2015 | Cho | |
| 2015/0201726 | A1 | 7/2015 | Prats | |
| 2015/0205279 | A1 | 7/2015 | Simeth | |
| 2015/0237982 | A1 * | 8/2015 | Kock | A45D 1/04 132/229 |
| 2016/0100681 | A1 | 4/2016 | Smal | |
| 2016/0213117 | A1 | 7/2016 | Keong | |
| 2016/0255937 | A1 * | 9/2016 | De Benedictis | A45D 2/367 |
| 2016/0286928 | A1 * | 10/2016 | Weatherly | A45D 1/28 |
| 2017/0019978 | A1 | 1/2017 | Lashina et al. | |
| 2017/0164708 | A1 | 6/2017 | Degrood | |
| 2017/0202332 | A1 * | 7/2017 | Keong | A45D 2/12 |
| 2017/0231353 | A1 | 8/2017 | Romeo | |
| 2017/0360174 | A1 | 12/2017 | Moore et al. | |
| 2018/0035776 | A1 | 2/2018 | Weatherly et al. | |
| 2018/0075776 | A1 | 3/2018 | Heitmann et al. | |
| 2019/0045901 | A1 | 2/2019 | Kock | |
| 2019/0150824 | A1 | 5/2019 | Gerhardt et al. | |
| 2019/0261757 | A1 | 8/2019 | Abramov et al. | |
| 2019/0307221 | A1 | 10/2019 | Whitaker et al. | |
| 2019/0350343 | A1 * | 11/2019 | Katzarov | A45D 44/005 |
| 2019/0387856 | A1 | 12/2019 | Nowak et al. | |
| 2020/0008549 | A1 | 1/2020 | Barber et al. | |
| 2020/0093254 | A1 * | 3/2020 | Charraud | A45D 44/005 |
| 2020/0098174 | A1 | 3/2020 | Charraud et al. | |
| 2020/0146413 | A1 | 5/2020 | Mathiaszyk et al. | |
| 2020/0201266 | A1 | 6/2020 | Joyce et al. | |
| 2020/0217779 | A1 | 7/2020 | Brada et al. | |
| 2021/0082310 | A1 * | 3/2021 | Moore | A45D 44/005 |
| 2023/0162616 | A1 | 5/2023 | Moore et al. | |
| 2023/0270222 | A1 | 8/2023 | Hickey et al. | |
| 2023/0292901 | A1 | 9/2023 | Hickey et al. | |
| 2023/0292902 | A1 | 9/2023 | Hickey et al. | |
| 2023/0292903 | A1 | 9/2023 | Hickey et al. | |
| 2023/0309674 | A1 | 10/2023 | Hickey et al. | |
| 2023/0337804 | A1 | 10/2023 | Hickey et al. | |

FOREIGN PATENT DOCUMENTS

| | | | | | |
|---|---|---|---|---|---|
| CN | 1154783 | A | | 7/1997 | |
| CN | 101744444 | A | | 6/2010 | |
| CN | 202341161 | U | | 7/2012 | |
| CN | 202941590 | U | | 5/2013 | |
| CN | 103228170 | A | | 7/2013 | |
| CN | 204270051 | U | | 4/2015 | |
| CN | 104814594 | A | | 8/2015 | |
| CN | 105231632 | A | | 1/2016 | |
| CN | 105411148 | A | * | 3/2016 | A45D 1/18 |
| CN | 205125380 | U | | 4/2016 | |
| CN | 105764376 | A | | 7/2016 | |
| CN | 107105850 | A | | 8/2017 | |
| CN | 107625268 | A | | 1/2018 | |
| CN | 108041790 | A | | 5/2018 | |
| CN | 207544571 | U | | 6/2018 | |
| CN | 110531677 | A | | 12/2019 | |
| CN | 111405855 | A | | 7/2020 | |
| CN | 212729094 | U | | 3/2021 | |
| CN | 116157040 | A | | 5/2023 | |
| DE | 4418292 | A1 | | 11/1995 | |
| DE | 202018005785 | U1 | | 1/2019 | |
| EP | 1108376 | B1 | | 9/2004 | |
| EP | 2359710 | A1 | | 8/2011 | |
| EP | 2359711 | A1 | | 8/2011 | |
| EP | 2510826 | A1 | | 10/2012 | |
| EP | 2386219 | B1 | | 4/2013 | |
| EP | 3228240 | A1 | | 10/2017 | |
| EP | 2676568 | B1 | | 1/2018 | |
| EP | 3460433 | A1 | | 3/2019 | |
| EP | 3491960 | A1 | | 6/2019 | |
| EP | 3429420 | B1 | | 8/2019 | |
| EP | 3518710 | A1 | | 8/2019 | |
| EP | 3573493 | A1 | | 12/2019 | |
| EP | 3595524 | A1 | | 1/2020 | |
| EP | 3629889 | A1 | | 4/2020 | |
| EP | 3685134 | A1 | | 7/2020 | |
| EP | 3386341 | B1 | | 10/2020 | |
| EP | 3178347 | B1 | | 10/2021 | |
| ES | 1029102 | U | | 4/1995 | |
| FR | 2942378 | B1 | | 4/2014 | |
| GB | 2456233 | A | * | 7/2009 | A45D 1/02 |
| GB | 2477834 | A | | 8/2011 | |
| GB | 2533602 | A | | 6/2016 | |
| GB | 2535504 | A | | 8/2016 | |
| GB | 2569647 | A | | 6/2019 | |
| GB | 2569655 | A | | 6/2019 | |
| GB | 2632005 | A | * | 1/2025 | A46B 15/0006 |
| GB | 2633027 | A | * | 3/2025 | A45D 2/36 |
| JP | 04-061804 | A | | 2/1992 | |
| JP | 2013-536699 | A | | 9/2013 | |
| JP | 2014-516742 | A | | 7/2014 | |
| JP | 2019-005642 | A | | 1/2019 | |
| KR | 10-2011-0002760 | A | | 1/2011 | |
| KR | 20110140038 | A | | 12/2011 | |
| KR | 101222692 | B1 | * | 1/2013 | A45D 1/18 |
| KR | 10-1452985 | B1 | | 10/2014 | |
| KR | 20150060494 | A | | 6/2015 | |
| KR | 10-1625834 | B1 | | 5/2016 | |
| KR | 10-2017-0052803 | A | | 5/2017 | |
| KR | 10-2017-0122407 | A | | 11/2017 | |
| KR | 101909394 | B1 | | 10/2018 | |
| NO | 2018/167073 | A1 | | 9/2018 | |
| TW | 201243335 | A | | 11/2012 | |
| WO | 82/03520 | A1 | | 10/1982 | |
| WO | 2004/067829 | A1 | | 8/2004 | |
| WO | 2008062293 | A1 | | 5/2008 | |
| WO | 2010/016072 | A1 | | 2/2010 | |
| WO | 2010/097779 | A1 | | 9/2010 | |
| WO | 2012028862 | A1 | | 3/2012 | |
| WO | 2013/171732 | A1 | | 11/2013 | |
| WO | 2013/190492 | A1 | | 12/2013 | |
| WO | 2014/001128 | A1 | | 1/2014 | |
| WO | 2014001769 | A1 | | 1/2014 | |
| WO | 2014/076873 | A1 | | 5/2014 | |
| WO | 2015/043094 | A1 | | 4/2015 | |
| WO | 2015/067484 | A1 | | 5/2015 | |
| WO | 2015071656 | A1 | | 5/2015 | |
| WO | 2016132116 | A1 | | 8/2016 | |
| WO | 2017/100229 | A1 | | 6/2017 | |
| WO | 2017/130192 | A1 | | 8/2017 | |
| WO | 2018/060232 | A1 | | 4/2018 | |
| WO | 2018/140085 | A1 | | 8/2018 | |
| WO | 2018/219899 | A1 | | 12/2018 | |
| WO | 2019/057575 | A1 | | 3/2019 | |
| WO | 2019/122850 | A1 | | 6/2019 | |
| WO | 2019122838 | A1 | | 6/2019 | |
| WO | 2019122839 | A1 | | 6/2019 | |
| WO | 2019/129875 | A1 | | 7/2019 | |
| WO | 2019/154662 | A1 | | 8/2019 | |

(56) References Cited

FOREIGN PATENT DOCUMENTS

| | | | | |
|---|---|---|---|---|
| WO | 2020/131472 | A1 | 6/2020 | |
| WO | 2020120348 | A1 | 6/2020 | |
| WO | 2022/023708 | A1 | 2/2022 | |
| WO | 2022/023709 | A1 | 2/2022 | |
| WO | 2022/023711 | A1 | 2/2022 | |
| WO | 2022/023718 | A1 | 2/2022 | |
| WO | WO-2023032443 | A1 * | 3/2023 | ..... A45D 1/08 |
| WO | WO-2025074122 | A1 * | 4/2025 | ..... A45D 1/28 |
| WO | WO-2025149752 | A1 * | 7/2025 | ..... A45D 6/20 |

OTHER PUBLICATIONS

Jemella Limited. Opposition to European Patent No. 4188152. Apr. 2, 2025 (Year: 2025).*
Machine translation of EP 2359710 (Year: 2025).*
International Search Report and Written Opinion received for PCT Patent Application No. PCT/GB2021/051875, mailed on Oct. 7, 2021, 9 pages.
International Search Report and Written Opinion received for PCT Patent Application No. PCT/GB2021/051881, mailed on Nov. 4, 2021, 9 pages.
International Search Report and Written Opinion received for PCT Patent Application No. PCT/GB2021/051882, mailed on Oct. 25, 2021, 12 pages.
International Search Report and Written Opinion received for PCT Patent Application No. PCT/GB2021/051884, mailed on Nov. 5, 2021, 9 pages.
International Search Report and Written Opinion received for PCT Patent Application No. PCT/GB2021/051877, mailed on Oct. 27, 2021, 9 pages.
International Search Report and Written Opinion received for PCT Patent Application No. PCT/GB2021/051878, mailed on Oct. 15, 2021, 10 pages.
International Search Report and Written Opinion received for PCT Patent Application No. PCT/GB2021/051880, mailed on Oct. 22, 2021, 11 pages.
Search Report received for GB Application No. 2011770.1, mailed on Oct. 19, 2020, 1 page.
Search Report received for GB Application No. 2011772.7, mailed on Oct. 20, 2020, 2 page.
Search Report received for GB Application No. 2011777.6, mailed on Oct. 19, 2020, 1 page.
Search Report received for GB Application No. 2011782.6, mailed on Nov. 9, 2020, 1 page.
Search Report received for GB Application No. 2011774.3, mailed on Oct. 19, 2020, 1 page.
Search Report received for GB Application No. 2011776.8, mailed on Oct. 20, 2020, 2 pages.
International Search Report and Written Opinion received for PCT Patent Application No. PCT/GB2021/051874, mailed on Oct. 20, 2021, 10 pages.
International Search Report and Written Opinion received for PCT Patent Application No. PCT/GB2021/051873, mailed on Oct. 19, 2021, 10 pages.
International Search Report and Written Opinion received for PCT Patent Application No. PCT/GB2021/051876, mailed on Oct. 11, 2021, 9 pages.
International Search Report and Written Opinion received for PCT Patent Application No. PCT/GB2021/051879, mailed on Oct. 19, 2021, 9 pages.
International Search Report and Written Opinion received for PCT Patent Application No. PCT/GB2021/051883, mailed on Oct. 7, 2021, 9 pages.
Sebastian O.H. Madgwick, "An efficient orientation filter for inertial and inertial/magnetic sensor arrays", University of Bristol, Apr. 30, 2010, pp. 1-32.
Rohm Semiconductor, "Applications for Hall Effect IC Switches in Portable Applications", Hall Effect ICs in Portable Electronics, 2008, 8 pages.
Cambridge English Dictionary, "cordless", Sep. 21, 2017, https://web.archive.org/web/20170921173215/https://dictionary.cambridge.org/dictionary/english/cordless, accessed via "The Wayback Machine" in May 2025, 5 pages.
Sintef—WoodCFD Project, "Clean and efficient wood stoves through improved batch combustion models and CFD modelling approaches", Newsletter Jan. 2015, Jan. 2015, 4 pages.
John Mulindi, "Root-mean-square (r.m.s. ) value", Electrical and Control Systems, Dec. 17, 2020, https://web.archive.org/web/20201217200603/https://www.electricalandcontrol.com/root-mean-square-r.m-s-value/, accessed via "The Wayback Machine" in May 2025, 7 pages.

* cited by examiner

HAIRSTYLING DEVICE

CROSS-REFERENCE TO PRIOR APPLICATION

This application is a § 371 National Stage Application of PCT International Application No. PCT/GB2021/051875 filed Jul. 21, 2021, which claims the priority of United Kingdom Application No. 2011770.1, filed Jul. 29, 2020.

TECHNICAL FIELD

The present disclosure concerns a hairstyling device. In particular, but not exclusively, the present disclosure concerns measures, including methods, apparatus and computer programs, for operating a hairstyling device.

BACKGROUND

Hairstyling devices, also referred to as hairstyling appliances, are used to form hair into desired shapes or styles. In particular, heated hairstyling devices use the action of heat, and optionally also mechanical means, to style the hair in a desired manner.

An example of such a hairstyling device is a hair straightening device (also referred to as a hair straightener, or hairstyling iron). Such a hairstyling device typically comprises two articulated arms which are pivotally attached to each other at one end, and to which one or more heatable plates are attached. Where both arms have a heatable plate, the heatable plates are generally positioned on inner opposed surfaces of the arms. The heatable plates have hair-contactable surfaces which are operable to come into contact with, and apply heat to, hair during use of the hairstyling device. The heatable plates (and thus the hair-contactable surfaces) can be heated by one or more heating elements.

However, the flexibility and/or versatility of known hairstyling devices is limited. This in turn may limit the ability of known hairstyling devices to achieve a desired style. For example, known hairstyling devices typically dump heat when they come into contact with a tress of hair. This may be relatively inefficient, as well as potentially causing damage to the hair. Further, known hairstyling devices generally rely on a user to use the hairstyling device correctly, in order to achieve a desired style. In some cases, for example, too much or too little heat, and/or too much or too little clamping pressure, may be applied to hair. This can cause thermal and/or mechanical hair damage, and/or can prevent the desired style from being achieved. If the desired style is not achieved using the hairstyling device in a first pass, e.g. due to incorrect or suboptimal use of the hairstyling device, a user may repeat the pass one or more times on the same portion of hair. As well as increasing the risk of damage to the hair, this repetition involves additional time and/or power consumption. In some cases, the desired style is not achieved even with repeated passes.

It is therefore desirable to provide an improved hairstyling device and/or improved methods of operating a hairstyling device.

SUMMARY

According to an aspect of the present disclosure, there is provided a hairstyling device comprising: a heatable hair contact member having a hair-contactable surface, the hair contact member being operable to apply heat to a tress of hair via the hair-contactable surface by movement of the hair contact member along the tress of hair between a first end of the tress and a second end of the tress; sensor equipment configured to generate sensor output indicative of current use of the hairstyling device; and a controller configured to: receive the sensor output from the sensor equipment; determine, based on the sensor output, that the hair contact member is at the first end of the tress or the second end of the tress; and control the hairstyling device to perform an action based on the determining.

By determining that the hair contact member is at the first end of the tress (e.g. the hair-root end of the tress), the start of the pass may be detected. Similarly, by determining that the hair contact member is at the second end of the tress (e.g. the hair-tip end of the tress), the end of the pass may be detected. As such, the boundaries of the pass (namely the start and end) may be identified by the hairstyling device, and used to control the hairstyling device. This enables a finer and/or more intelligent control of the hairstyling device compared to a case in which the boundaries of a pass are not identified.

In embodiments, the controller is configured to control heating of the heatable hair contact member based on the determining.

In embodiments, the first end of the tress comprises a hair-root end of the tress. In embodiments, the second end of the tress comprises a hair-tip end of the tress.

In embodiments, the controller is configured to: in response to determining that the hair contact member is at the hair-root end of the tress, decrease an amount of energy used to heat the hair contact member; and in response to determining that the hair contact member is at the hair-tip end of the tress, increase an amount of energy used to heat the hair contact member. This enables a temperature ramp to be implemented along the tress, reducing the likelihood of hair damage at the hair-root end at the tress whilst ensuring that sufficient heat is delivered to the hair-tip end to achieve a desired style.

In embodiments, the controller is configured to: in response to determining that the hair contact member is at the hair-root end of the tress, increase an amount of energy used to heat the hair contact member; and in response to determining that the hair contact member is at the hair-tip end of the tress, decrease an amount of energy used to heat the hair contact member. As such, after a pass along the tress has ended (and thus hair is no longer being styled), the amount of energy used to heat the hair contact member can be reduced. This reduces power consumption compared to a case in which a constant amount of energy is used to heat the hair contact member throughout use of the hairstyling device.

In embodiments, the controller is configured to: in response to determining that the hair contact member is at the hair-root end of the tress, cause the operating temperature of the hair contact member to decrease; and in response to determining that the hair contact member is at the hair-tip end of the tress, cause the operating temperature of the hair contact member to increase. Controlling heating of the hair contact member in this manner allows a predetermined temperature delivery profile (e.g. a temperature ramp) to be applied as the hair contact member moves along the tress.

In embodiments, the controller is configured to: in response to determining that the hair contact member is at the hair-root end of the tress, cause the operating temperature of the hair contact member to increase; and in response to determining that the hair contact member is at the hair-tip end of the tress, cause the operating temperature of the hair contact member to decrease. As such, after a pass along the tress has ended (and thus hair is no longer being styled), the operating temperature can be decreased, thereby reducing power consumption.

In embodiments, the sensor output indicates a use characteristic of the hairstyling device. As such, the determination that the hair contact member is at the first end or the second end of the tress may be on the basis of how the hairstyling device is being used. In embodiments, the use characteristic comprises a speed of the hair contact member. In embodiments, the use characteristic comprises a position of the hair contact member. In embodiments, the hair contact member is moveable between an open configuration and a closed configuration. In such embodiments, the use characteristic indicates whether the hair contact member is in the open configuration or the closed configuration.

In embodiments, the sensor equipment comprises an inertial measurement unit, IMU. In such embodiments, the use characteristic is indicative of movement of the hair contact member. In embodiments, the controller is configured to process the sensor output using a velocity and/or position estimation algorithm. In embodiments, the velocity and/or position estimation algorithm comprises a Madgwick filter. In embodiments, the velocity and/or position estimation algorithm comprises a machine learning model. In embodiments, the sensor equipment comprises a Hall effect sensor.

In embodiments, the controller is configured to: further determine, based on the sensor output, that the hair contact member is moving away from the first end of the tress towards the second end of the tress; and control heating of the hair contact member based on the further determining.

In embodiments, the hairstyling device comprises a hair straightening device and/or a hair curling device.

According to an aspect of the present disclosure, there is provided a method of operating a hairstyling device, the hairstyling device comprising: a heatable hair contact having a hair-contactable surface, the hair contact member being operable to apply heat to a tress of hair via the hair-contactable surface by movement of the hair contact member along the tress of hair between a first end of the tress and a second end of the tress; and sensor equipment configured to generate sensor output indicating a use characteristic of the hairstyling device indicative of current use of the hairstyling device, the method comprising: receiving the sensor output from the sensor equipment; determining, based on the sensor output, that the hair contact member is at the first end of the tress or the second end of the tress; and controlling the hairstyling device to perform an action based on the determining.

According to an aspect of the present disclosure, there is provided a computer program comprising a set of instructions which, when executed by a computerised device, cause the computerised device to perform a method of operating a hairstyling device, the hairstyling device comprising: a heatable hair contact member having a hair-contactable surface, the hair contact member being operable to apply heat to a tress of hair via the hair-contactable surface by movement of the hair contact member along the tress of hair between a first end of the tress and a second end of the tress; and sensor equipment configured to generate sensor output indicating a use characteristic of the hairstyling device indicative of current use of the hairstyling device, the method comprising: receiving the sensor output from the sensor equipment; determining, based on the sensor output, that the hair contact member is at the first end of the tress or the second end of the tress; and controlling the hairstyling device to perform an action based on the determining.

It will of course be appreciated that features described in relation to one aspect of the present invention may be incorporated into other aspects of the present invention. For example, a method of the invention may incorporate any of the features described with reference to an apparatus of the invention and vice versa.

BRIEF DESCRIPTION OF THE DRAWINGS

Embodiments of the present disclosure will now be described by way of example only with reference to the accompanying drawings, of which.

DETAILED DESCRIPTION

Figure 1A:
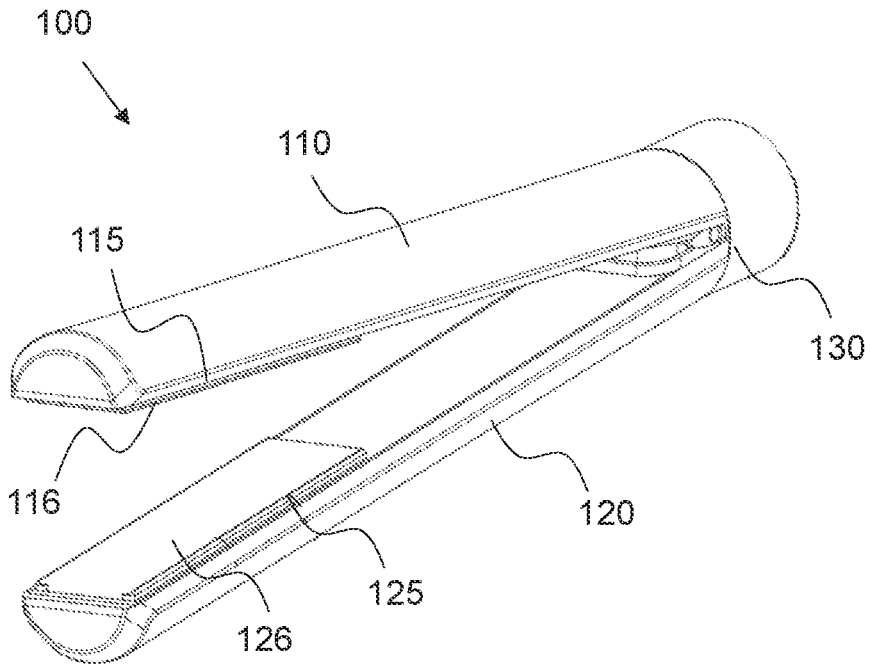
FIGS. 1A and 1B are perspective views of a hairstyling device according to embodiments.
Figure 1B:
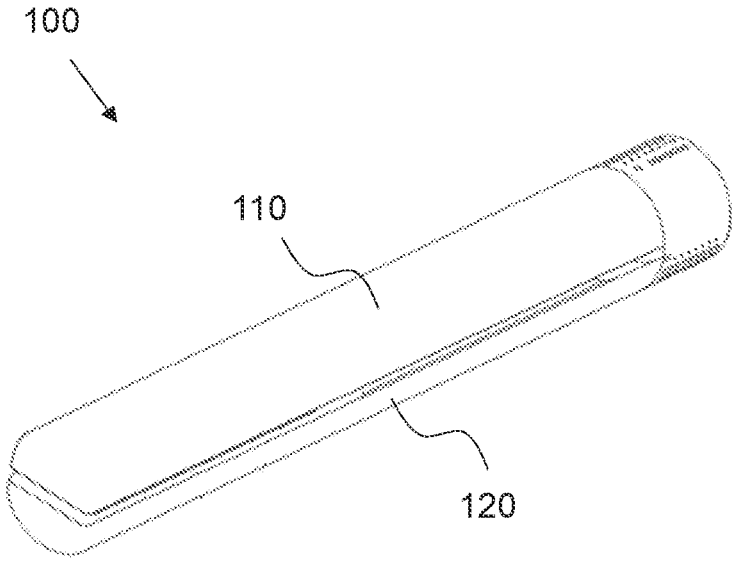

FIGS. 1A and 1B show perspective views of a hairstyling device 100 according to embodiments. The hairstyling device 100, and/or components thereof, may be used to implement the methods described herein. In the embodiments shown in FIGS. 1A and 1B, the hairstyling device 100 comprises a hair straightener.

The hairstyling device 100 comprises a first arm 110 and a second arm 120, which are joined together at one end by a hinge 130. Each arm 110, 120 comprises a heatable plate 115, 125. One or both of the heatable plates 115, 125 are heatable, e.g. by a heating element (not shown). In some embodiments, one or both of the heatable plates 115, 125 comprises a resistive plate. Such resistive plates may be heated directly, e.g. without requiring a separate heating element. Each heatable plate 115, 125 comprises a hair-contactable surface 116, 126. The hair-contactable surfaces 116, 126 are arranged such that they face each other. The arms 110, 120 are hinged such that they can move between an open position (as shown in FIG. 1A), and a closed position (as shown in FIG. 1B). In the closed position, the hair-contactable surfaces 116, 126 are brought towards each other such that hair to be styled can be held between the hair-contactable surfaces 116, 126. In some embodiments, the hair-contactable surfaces 116, 126 are brought into contact when the arms 110, 120 are in the closed position. In other embodiments, the hair-contactable surfaces 116, 126 are not brought into contact.

The arms 110, 120 may be moved between the open position and the closed position by a user. For example, the user presses the arms 110, 120 together when using the hairstyling device 100 (in order to style hair between the hair-contactable surfaces 116, 126), and releases the arms 110, 120 and/or pulls the arms 110, 120 apart when styling is complete. In embodiments, the hairstyling device 100 comprises biasing means (not shown), e.g. one or more springs and/or magnets. The biasing means urge the arms 110, 120 towards the open position, such that the arms 110, 120 revert to the open position when a user is not pressing the arms 110, 120 together.

In alternative embodiments, the arms 110, 120 are not pivotable about a hinge 130. For example, the arms 110, 120 may be substantially parallel to one another. In either case, a user may press the arms 110, 120 together to style hair.

In the embodiments shown in FIGS. 1A and 1B, the hairstyling device 100 comprises a cordless hairstyling device. For example, the hairstyling device 100 may be powered by a rechargeable battery. In alternative embodiments, the hairstyling device 100 is externally powered, e.g. via one or more external power cords (not shown).

Figure 2:
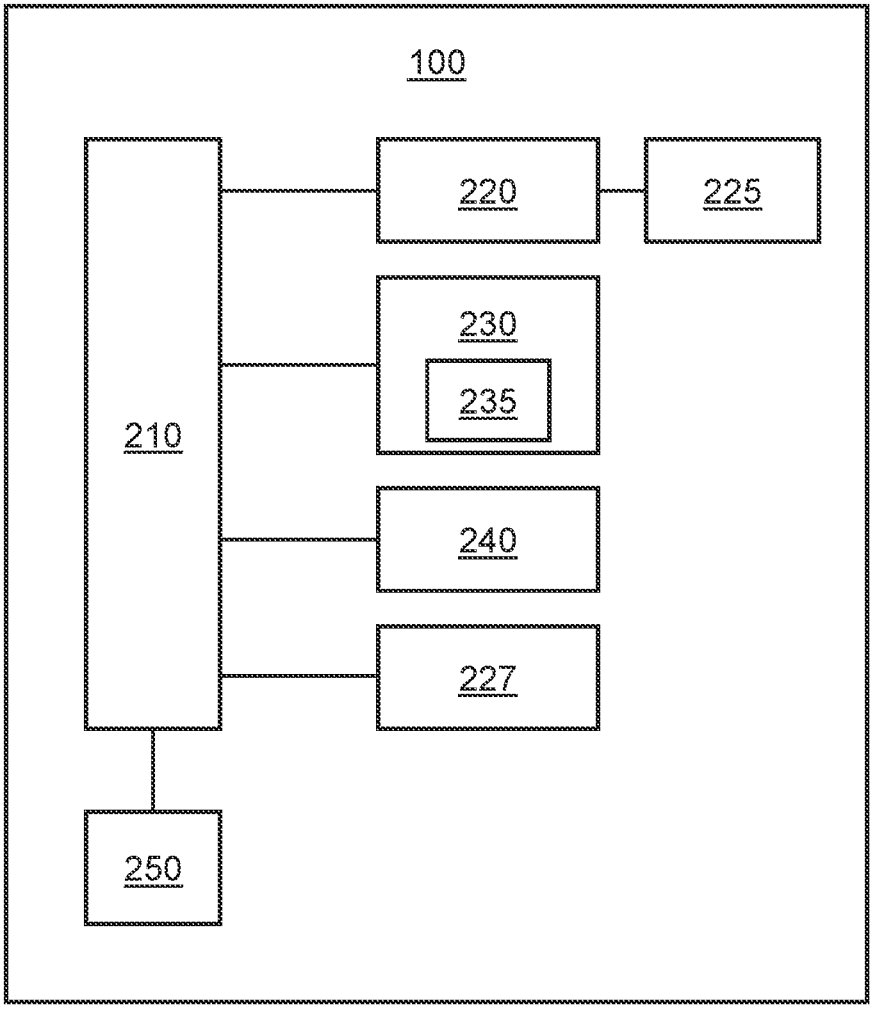
FIG. 2 is a schematic diagram of a hairstyling device according to embodiments.

FIG. 2 shows a schematic block diagram of the hairstyling device 100, according to embodiments.

The hairstyling device 100 comprises a controller 210. The controller 210 is operable to perform various data processing and/or control functions according to embodiments, as will be described in more detail below. The controller 210 may comprise one or more components. The one or more components may be implemented in hardware and/or software. The one or more components may be co-located or may be located remotely from each other in the hairstyling device 100. The controller 210 may be embodied as one or more software functions and/or hardware modules. In embodiments, the controller 210 comprises one or more processors configured to process instructions and/or data. Operations performed by the one or more processors may be carried out by hardware and/or software. The controller 210 may be used to implement the methods described herein. In embodiments, the controller 210 is operable to output control signals for controlling one or more components of the hairstyling device 100.

In embodiments, the hairstyling device 100 comprises a heating element 220. The heating element 220 may, for example, be operable to convert electrical energy into heat. The heating element 220 is configured to cause hair to be heated by the hairstyling device 100. The controller 210 is operable to control the heating element 220. For example, the controller 210 may be operable to apply energy (e.g. electrical energy) to the heating element 220, e.g. via one or more control signals generated by the controller 210.

In embodiments, the hairstyling device comprises a heatable hair contact member 225. The hair contact member 225 may be heatable by the heating element 220. In alternative embodiments, the hair contact member 225 is heatable directly, i.e. without requiring a separate heating element 220. In embodiments, the hair contact member 225 comprises one or more heatable plates. For example, the hair contact member 225 may comprise one or more of the heatable plates 115, 125 described with reference to FIGS. 1A and 1B above. The hair contact member 225 may comprise one or more hair-contactable surfaces, e.g. the hair-contactable surfaces 116, 126 described above. The hair contact member 225 is operable to apply heat to hair via the one or more hair-contactable surfaces 116, 126. As such, the controller 210 controls heating of the hair contact member 225, e.g. by controlling the heating element 220, which causes heat to be delivered to hair in contact with the one or more hair-contactable surfaces 116, 126 of the hair contact member 225.

In embodiments, the hair contact member 225 comprises opposing first and second hair-contactable surfaces 116, 126. The opposing first and second hair-contactable surfaces 116, 126 are arranged to heat hair engaged therebetween. In embodiments, the hair contact member 225 is operable to apply heat to hair by movement of the hair contact member 225 along a tress of hair, e.g. from a first end of the tress towards a second end of the tress. Movement of the hair contact member 225 along the tress may be referred to as a 'pass'. In alternative embodiments, the hair contact member 225 comprises a single hair-contactable surface. The hair contact member 225 may comprise moveable arms, such as the first arm 110 and second arm 120 described with reference to FIGS. 1A and 1B above.

In embodiments, the hairstyling device 100 comprises a closing mechanism 227. The closing mechanism 227 may be operable to close and/or open the hair contact member 225. The closing mechanism 227 may comprise an electromechanical closing mechanism. The closing mechanism 227 is operable to receive control signals from the controller 210, thereby allowing the controller 210 to control the closing mechanism 227. In embodiments where the hair contact member 225 comprises opposing first and second hair-contactable surfaces 116, 126, arranged to receive hair therebetween, the closing mechanism 227 is operable to adjust a distance between the first and second hair-contactable surfaces 116, 126. This will be described in more detail below.

In embodiments, the hairstyling device 100 comprises sensor equipment 230. The sensor equipment 230 comprises one or more sensors. Examples of such sensors include, but are not limited to, IMUs, Hall effect sensors, temperature sensors, power sensors, proximity sensors, motion sensors, gyroscopes, accelerometers, magnetometers, etc. In embodiments, the sensor equipment 230 comprises one or more processors. The controller 210 is operable to receive signals (e.g. sensor output) from the sensor equipment 230. The sensor output from the sensor equipment 230 may be used to control the hairstyling device 100. In embodiments, the controller 210 is operable to control the sensor equipment 230.

In the embodiments shown in FIG. 2, the sensor equipment 230 comprises an IMU 235. In such embodiments, the controller 210 is operable to receive signals from the IMU 235 indicative of movement of the hairstyling device 100. In embodiments, the IMU 235 comprises an accelerometer, a gyroscope and a magnetometer. Each of the accelerometer, gyroscope and magnetometer has three axes, or degrees of freedom (x, y, z). As such, the IMU 235 may comprise a 9-axis IMU. In alternative embodiments, the IMU 235 comprises an accelerometer and a gyroscope, but does not comprise a magnetometer. In such embodiments, the IMU 235 comprises a 6-axis IMU. A 9-axis IMU may produce more accurate measurements than a 6-axis IMU, due to the additional degrees of freedom. However, a 6-axis IMU may be preferable to a 9-axis IMU in some scenarios. For example, some hairstyling devices may cause and/or encounter magnetic disturbances during use. This may be a particular consideration for cordless hairstyling devices, which comprise an on-board power source, as well as hairstyling devices comprising heating elements. Heating, magnetism and/or magnetic inductance on the device and/or other magnetic disturbances can affect the behaviour of the magnetometer. As such, in some cases, a 6-axis IMU is more reliable and/or accurate than a 9-axis IMU. The IMU is configured to output data indicating accelerometer and gyroscope signals (and in some embodiments magnetometer signals). In an alternative embodiment, the IMU 235 may comprise an accelerometer, but does not comprise a gyroscope or a magnetometer. In such an embodiment, the IMU 235 comprises a 3-axis IMU.

In embodiments, the hairstyling device 100 comprises a user interface 240. The user interface 240 may comprise an audio and/or visual interface, for example. In embodiments, the user interface 240 comprises a display (for example a touch-screen display). In embodiments, the user interface 240 comprises an audio output device such as a speaker. In embodiments, the user interface 240 comprises a haptic feedback generator configured to provide haptic feedback to a user. The controller 210 is operable to control the user interface 240, e.g. to cause the user interface 240 to provide output for a user. In some embodiments, the controller 210 is operable to receive data, e.g. based on user input, via the user interface 240.

The hairstyling device 100 also comprises a memory 250. The memory 250 is operable to store various data according to embodiments. The memory may comprise at least one volatile memory, at least one non-volatile memory, and/or at least one data storage unit. The volatile memory, non-volatile memory and/or data storage unit may be configured to store computer-readable information and/or instructions for use/execution by the controller 210.

The hairstyling device 100 may comprise more, fewer and/or different components in alternative embodiments. In particular, at least some of the components of the hairstyling device 100 shown in FIGS. 1A, 1B and/or 2 may be omitted (e.g. may not be required) in some embodiments. For example, at least one of the heating element 220, hair contact member 225, closing mechanism 227, sensor equipment 230, user interface 240 and memory 250 may be omitted in some embodiments. In some embodiments, the hairstyling device 100 does not comprise the moveable (e.g. pivotable) arms 110, 120.

Figure 3:
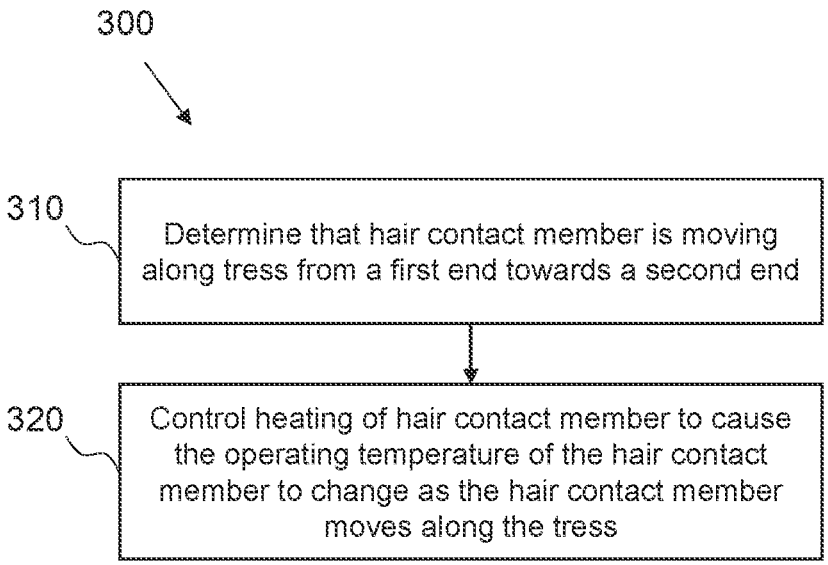
FIG. 3 is a flow diagram showing a method of operating a hairstyling device according to embodiments.

FIG. 3 shows a method 300 of operating a hairstyling device, according to embodiments. The method 300 may be used to operate the hairstyling device 100 described above with reference to FIGS. 1A, 1B and 2. In the embodiments of FIG. 3, the hairstyling device 100 comprises the heatable hair contact member 225 having a hair-contactable surface 116, 126. The hair contact member 225 is operable to apply heat to a tress of hair of a user via the hair-contactable surface 116, 126. In embodiments, the method 300 is performed at least in part by the controller 210.

In step 310, it is determined that the hair contact member 225 is moving along the tress from a first end of the tress towards a second end of the tress.

In step 320, based on the determining, the heating element 220 is controlled to cause the operating temperature of the hair contact member 225 to change as the hair contact member 225 moves along the tress from the first end of the tress towards the second end of the tress.

In embodiments, the first end comprises a hair-root end of the tress, and the second end comprises a hair-tip end of the tress. The first end may be located at the hair-root or at an intermediate point on the tress. The second end may similarly be located at the hair-tip or at an intermediate point on the tress. The term 'hair-root end' as used herein refers to the end of the tress that is closest to the root of the hair. The term 'hair-tip' end refers to the end of the tress that is closest to the tip of the hair (e.g. farthest from the root). In some examples, the tress extends all the way between the root of the hair (e.g. from the head of the user) and the tip of the hair. In other examples, however, the tress extends partway between the root of the hair and the tip of the hair. In such examples, the hair-root end of the tress may be located at a point that is not at the actual root of the hair, and/or the hair-tip end of the tress may be located at a point that is not at the actual tip of the hair.

The operating temperature of the hair contact member 225 thus varies as the hair contact member 225 moves along the tress. By adapting and/or modulating the delivery of heat to hair along the tress, the heat distribution across the tress can be controlled. The temperature of the hair may be higher at the hair-root end of a tress compared to the hair-tip end of the tress. However, hair at the hair-tip end may require a greater amount of heat to be applied than hair at the hair-root end in order to be styled in a desired manner (e.g. straightened). Hair at the hair-tip end is older than hair at the hair-root end, and older hair may require more heat in order to be styled in the desired manner. Using a constant operating temperature of the hair contact member 225 along the tress may therefore result in thermal damage to hair at the hair-root end of the tress (due to too much heat being delivered at the hair-root end), and/or may prevent the desired style from being achieved (due to too little heat being delivered at the hair-tip end). Providing a heat delivery profile that increases from the hair-root end towards the hair-tip end of the tress thus reduces the likelihood of thermal damage (particularly protecting the younger hair at the hair-root end), whilst ensuring that sufficiently high temperatures are delivered to hair at the hair-tip end to achieve the desired style. Such a heat delivery profile may be referred to as a 'root-to-tip' heat delivery profile. In embodiments, the operating temperature of the hair contact member 225 is caused to increase as the hair contact member 225 moves along the tress. In alternative embodiments, the operating temperature of the hair contact member 225 is caused to decrease as the hair contact member 225 moves along the tress.

In embodiments, the hairstyling device 100 comprises sensor equipment 230 configured to generate a sensor output dependent on movement of the hair contact member 225. The sensor output is processed to determine that the hair contact member 225 is moving along the tress. As such, the determination that the hair contact member 225 is moving along the tress may be made without user input and/or intervention, in some embodiments. In embodiments, the sensor equipment 230 comprises the IMU 235. One or more signals from the IMU 235 may be processed to determine that that the hair contact member 225 is moving along the tress. Additionally or alternatively, the sensor equipment 230 may comprise a Hall effect sensor. The Hall effect sensor may generate sensor output dependent on whether the hair contact member 225 is in an open configuration (e.g. where the arms 110, 120 are open) or a closed configuration (e.g. where the arms 110, 120 are closed). As such, a closing of the hair contact member 225 may be sensed, and used to determine that the hair contact member 225 is moving along the tress. In alternative embodiments, the determining of step 310 is performed without the use of sensor equipment. For example, the determining may be made on the basis of user input, e.g. via a user interface, one or more buttons on the hairstyling device 100, etc.

In embodiments, the hairstyling device 100 comprises the heating element 220 operable to heat the hair contact member 225. In such embodiments, controlling of heating of the hair contact member 225 comprises controlling the heating element 220.

In embodiments, a displacement of the hair contact member 225 from the first end of the tress is determined, based on the sensor output. In such embodiments, heating of the hair contact member 225 (e.g. controlling of the heating element 220) is based on the determined displacement. The displacement may be determined, for example, based on signals received from the IMU 235. In other examples, the start of the pass is identified (e.g. when the hair contact member 225 is at the hair-root end of the tress), and the displacement is determined based on an elapsed time from the start of the pass. The start of the pass may be identified based on a closing of the plates of the hair contact member 225, for example. Controlling heating of the hair contact member 225 based on the determined displacement enables a finer control of heat distribution along the tress.

In embodiments, heating of the hair contact member 225 is controlled based on a predetermined threshold operating temperature of the hair contact member 225. The predetermined threshold operating temperature is dependent on the determined displacement of the hair contact member 225 from the first end (e.g. the hair-root end) of the tress. Heating of the hair contact member 225 may be controlled such that the operating temperature of the hair contact member 225 is kept above the relevant predetermined threshold operating temperature, for example. In embodiments, a first predetermined threshold operating temperature is used for the first end of the tress, and a second predetermined threshold operating temperature is used for the second end of the tress, the second predetermined threshold operating temperature being higher than the first predetermined threshold operating temperature. In some embodiments, a third predetermined threshold operating temperature is used for a location on the tress that is between the first end and the second end. The third predetermined threshold operating temperature may be between the first and the second predetermined threshold operating temperatures.

In embodiments, a speed of the hair contact member 225 is determined, based on the sensor output. For example, the speed may be determined by processing one or more signals from the IMU 235. In such embodiments, heating of the hair contact member 225 is controlled based on the determined speed. In embodiments, heating of the hair contact member 225 is controlled to cause the operating temperature of the hair contact member 225 to change (e.g. increase) at a rate dependent on the determined speed. In other words, the rate of temperature change of the hair contact member 225 may be dependent on the speed at which the hair contact member 225 is moving. For example, a rate of temperature increase (or "temperature ramp") may be relatively steep if the hair contact member 225 is determined to be moving relatively quickly, and may be relatively shallow if the hair contact member 225 is determined to be moving relatively slowly. This allows for a finer control of the heat distribution along the tress, and/or enables the hairstyling device 100 to adapt to the user's behaviour. In embodiments, a heat delivery profile along the tress is dependent on the determined speed.

In embodiments, the sensor output is processed using a velocity and/or position estimation algorithm. In embodiments, the velocity and/or position estimation algorithm is configured to fuse accelerometer and gyroscope signals from an IMU. For example, determining that the hair contact member 225 is moving along the tress, determining a displacement of the hair contact member 225 from the first end, and/or determining the speed of the hair contact member 225, may be performed through use of the velocity and/or position estimation algorithm. In embodiments where a 9-axis IMU is used, the velocity and/or position estimation algorithm can determine an initial state using the signal from the magnetometer in addition to the accelerometer and gyroscope signals. In embodiments, the velocity and/or position algorithm comprises a Madgwick filter. The velocity and/or position estimation algorithm may be implemented using software or hardware, e.g. an application specific integrated circuit (ASIC), or may be implemented using a combination of hardware and software. The velocity and/or position estimation algorithm may be used in various methods described herein.

IMUs may suffer from noise, biases and/or drifts which, unless properly corrected for, can cause inaccuracies in the resulting calculations. For example, gyroscope signals may drift over time, the accelerometer may be biased by gravity, and both gyroscope and accelerometer signals may suffer from noise. In embodiments, at least some of the noise in the IMU signals is removed using filtering, for example high and/or low pass and/or median filters. In embodiments, a Madgwick filter is used to correct for gyroscope drift, by removing the magnitude of the gyroscope measurement error, in the direction or steepest direction of the estimated error, whilst fusing the accelerometer and gyroscope signals. The output of the Madgwick filter is a world-referenced orientation quaternion, or Madgwick quaternion, which gives the device an orientation. This quaternion is used to rotate the acceleration signals to the Earth's frame of reference. Once the acceleration is rotated, the proportion of gravity's pull on each axis is calculated and removed (i.e. gravity is compensated for). This provides a linear acceleration, which can be integrated to obtain a velocity, and then the velocity may be integrated to obtain a position and/or displacement. Each time the signals are integrated, the remaining errors arising from such biases and/or drifts increase. Such errors may therefore be particularly problematic for velocity and/or position measurements. The drift in the velocity is compensated for before it is integrated to obtain the position, which increases the accuracy of the measurements. The velocity and/or position measurements may comprise measurements for all 3 axes individually, or the directional components may be combined to provide a velocity magnitude and/or a position magnitude.

Alternative filters and/or algorithms may be used instead of, or in addition to, the Madgwick filter, in other embodiments. Examples of such filters include Kalman filters, extended Kalman filters, and/or Complementary filters such as Mahony filters. However, the Madgwick filter is less computationally expensive than other filters whilst achieving a comparable, or in some cases better, level of accuracy. This allows the Madgwick filter to be run on the hairstyling device 100 itself, rather than requiring an external processing device. This reduces latency compared to a case in which processing is carried out on an external processing data, as the need to transfer data between devices is avoided.

In embodiments, the speed may be determined by processing one or more signals from a 3-axis IMU. As described above, in such embodiments, heating of the hair contact member 225 is controlled based on the determined speed. In embodiments, heating of the hair contact member 225 is controlled to cause the operating temperature of the hair contact member 225 to change (e.g. increase) at a rate dependent on the determined speed. In other words, the rate of temperature change of the hair contact member 225 may be dependent on the speed at which the hair contact member 225 is moving. For example, a rate of temperature increase (or "temperature ramp") may be relatively steep if the hair contact member 225 is determined to be moving relatively quickly, and may be relatively shallow if the hair contact member 225 is determined to be moving relatively slowly. This allows for a finer control of the heat distribution along the tress, and/or enables the hairstyling device 100 to adapt to the user's behaviour. In embodiments, a heat delivery profile along the tress is dependent on the determined speed.

In embodiments, the sensor output is processed using a velocity and/or position estimation algorithm such as a machine learning model. In embodiments, a 3-axis IMU that comprises an accelerometer is used in combination with a machine learning model. For example, determining that the hair contact member 225 is moving along the tress, determining a displacement of the hair contact member 225 from the first end, and/or determining the speed of the hair contact member 225, may be performed through use of the machine learning model.

In embodiments where a 3-axis IMU is used, the machine learning model can determine an initial state using the signal from the 3-axis IMU. In embodiments, the machine learning model has been trained using a generalized nonlinear regression algorithm (such as Gaussian kernel regression and neural networks. The training data for the machine learning model uses 3-axis IMU data from previous uses of the hair styling device 100, along with target data from ground truth source, for example a Vicon motion capture system. It will be appreciated that the target data from a ground truth source can be captured using an alternative system. The machine learning model may be implemented using software or hardware, e.g. an application specific integrated circuit (ASIC), or may be implemented using a combination of hardware and software. The machine learning model may be used in various methods described herein.

As mentioned, the IMU (such as 3-axis IMUs) may suffer from noise, biases and/or drifts which, unless properly corrected for, can cause inaccuracies in the resulting calculations. For example, the accelerometer may be biased by gravity, and the accelerometer signals may suffer from noise. In embodiments, at least some of the noise in the accelerometer signals is removed using filtering, for example high and/or low pass and/or median filters.

In embodiments, a low pass filter is applied to each signal output of the 3-axis IMU to remove noise. Each signal is then combined into a single signal output. The proportion of force on the single signal output due to Gravity is then calculated and subtracted from the signal output to give an acceleration magnitude.

The previously trained machine learning model is then applied to the acceleration magnitude.

The machine learning model as described above is used to correct noise, biases and drift, such as velocity drift, as it simultaneously converts the acceleration magnitude to a velocity magnitude, by using a machine learning model that has been trained as previously described. In embodiments, the machine learning model is trained with motion acceleration magnitude training data and velocity magnitude ground truth data provided in previous uses of the hair styling device, and from a ground truth source for example a Vicon motion capture system.

In embodiments, a sliding window algorithm is used to generate input data for the machine learning model, which in preferred embodiments consists of twenty sample points simultaneously. In doing so, drift is compensated for the twentieth sample point of the calculated velocity by the machine learning model, which has considered that sample point and the previous nineteen sample points of the motion acceleration magnitude input data. However, it will be appreciated that a different number of sample points can be used as input data to the machine learning model. In this regard, the machine learning model can correct and/or compensate for noise, biases and/or drifts associated with the 3-axis IMU.

In an alternative embodiment, a low pass filter is applied to each signal output of the 3-axis IMU. Each of the three signal outputs is then processed separately. The proportion of force on each signal is then calculated and subtracted from each of the signal outputs to give three acceleration magnitudes (one acceleration magnitude per axis). The previously trained machine learning model as described above, is then applied to each acceleration magnitude individually. Similarly, the sliding window algorithm can be applied to generate input for the machine learning model. In other words, the machine learning model and the sliding window algorithm can be applied to each axis individually.

In embodiments, the velocity is integrated to obtain position and/or displacement. Since the drift has been compensated for in the calculated velocity, the position and/or displacement can be determined more accurately.

Therefore, the machine learning model in combination with the 3-axis IMU can be used to compensate for velocity drift and to determine the velocity, the position and/or the displacement of the hair styling device.

In embodiments, causing the operating temperature to change (e.g. increase) comprises adjusting (e.g. increasing) an amount of energy used to heat the hair contact member 225 as the hair contact member 225 moves along the tress from the first end of the tress towards the second end of the tress. For example, the amount of energy applied to the heating element 220 may be adjusted as the hair contact member 225 moves along the tress. As such, both the operating temperature of the hair contact member 225 and the amount of energy applied to the heating element 220 may increase as the hair contact member 225 moves along the tress, in such embodiments. In alternative embodiments, the amount of energy used to heat the hair contact member 225 is not increased as the hair contact member 225 moves along the tress. For example, the amount of energy used to heat the hair contact member 225 may be constant.

In embodiments, the operating temperature of the hair contact member 225 is caused to increase at a predetermined rate as the hair contact member 225 moves along the tress from the hair-root end towards the hair-tip end. The predetermined rate of increase may be based on a heat delivery profile along the tress. In some embodiments, the predetermined rate of increase is dependent on the speed of the hair contact member 225. The predetermined rate of increase may be dependent on other factors including, but not limited to, the type of hair being styled, whether the hair is wet or dry, the length of the tress of hair, previous uses of the hairstyling device, user preferences, etc. In embodiments, the predetermined rate of increase is dependent on a condition of the tress, e.g. defined by one or more hair damage parameters. This will be described in more detail below.

In embodiments, heating of the hair contact member 225 is controlled to cause the operating temperature of the hair contact member 225 when the hair contact member 225 is at the second end (e.g. the hair-tip end) to be between 40 and 80 degrees higher than the operating temperature of the hair contact member 225 when the hair contact member 225 is at the first end (e.g. the hair-root end). For example, the operating temperature when the hair contact member 225 is at the second end may be between 50 and 70 degrees higher, e.g. 60 degrees higher, than the operating temperature when the hair contact member 225 is at the first end. In some examples, the operating temperature when the hair contact member 225 is at the first end is 120° C., and the operating temperature when the hair contact member 225 is at the second end is 180° C. Such a difference in operating temperature between the first end and the second end enables the entire tress to achieve a desired style (e.g. to be straightened or curled), thereby reducing a styling time, whilst reducing the likelihood of thermal damage to the hair. The difference between operating temperatures at the first end and the second end may have other values in other embodiments.

In embodiments, the method 300 comprises determining whether the hairstyling device 100 is being used according to a first styling behaviour or a second styling behaviour. The heating element 220 is controlled in dependence on whether the hairstyling device 100 is being used according to the first styling behaviour or the second styling behaviour. In some such embodiments, heating of the hair contact member 225 is controlled to cause the operating temperature of the hair contact member 225 to change at a rate that is dependent on whether the hairstyling device 100 is being used according to the first styling behaviour or the second styling behaviour. For example, a first predetermined rate of increase may be used for a hair straightening behaviour, and a second, different predetermined rate of increase may be used for a hair curling behaviour. As such, a distinct temperature delivery profile may be used for different activities. This enables different styles to be achieved by the same hairstyling device 100, thereby improving the versatility of the hairstyling device 100, whilst reducing the likelihood of thermal damage, and reducing the styling time. In embodiments, the styling behaviour is identified using a classification algorithm and sensor data, as will be described in more detail below. In alternative embodiments, the styling behaviour is identified based on user input. In alternative embodiments, the specific styling behaviour is not identified. For example, the same temperature delivery profile (which may vary along the tress) may be used regardless of styling behaviour.

In alternative embodiments, e.g. where the hairstyling device 100 does not comprise the heating element 220, heating of the hair contact member 225 may be performed directly, e.g. by applying energy to the hair contact member 225 itself. In either case, heating of the hair contact member 225 is controlled such that the operating temperature of the hair contact member 225 varies along the tress.

Figure 4:
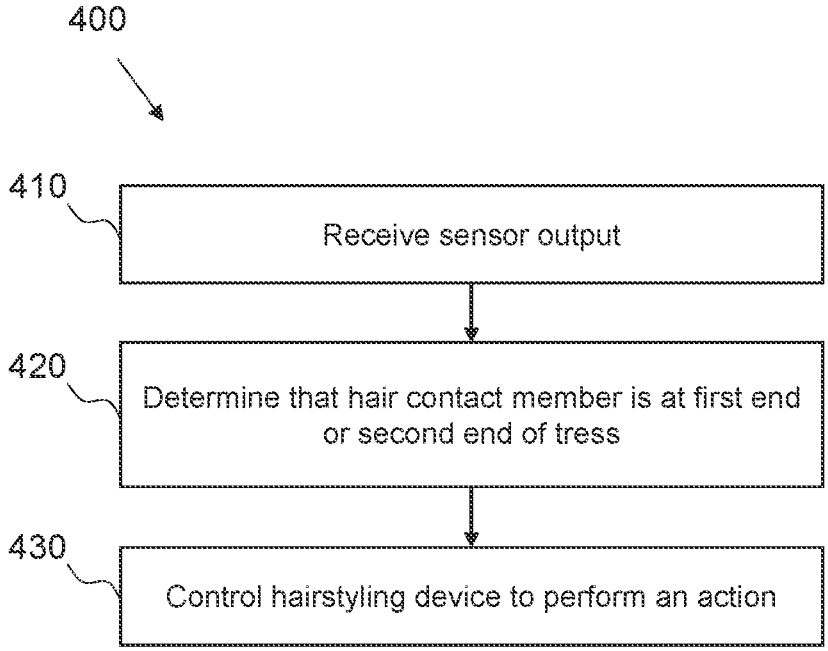
FIG. 4 is a flow diagram showing a method of operating a hairstyling device according to embodiments.

FIG. 4 shows a method 400 of operating a hairstyling device, according to embodiments. The method 400 may be used to operate the hairstyling device 100 described above with reference to FIGS. 1A, 1B and 2. In the embodiments of FIG. 4, the hairstyling device 100 comprises the heatable hair contact member 225 having a hair-contactable surface 116, 126. The hair contact member 225 is operable to apply heat to a tress of hair via the hair-contactable surface by movement of the hair contact member 225 along the tress of hair between a first end of the tress and a second end of the tress. In these embodiments, the hairstyling device 100 also comprises sensor equipment 230 configured to generate sensor output indicative of current use of the hairstyling device 100. In embodiments, the method 400 is performed at least in part by the controller 210.

In step 410, the sensor output is received from the sensor equipment 230.

In step 420, based on the sensor output, it is determined that the hair contact member 225 is at the first end of the tress or the second end of the tress.

In step 430, the hairstyling device 100 is controlled to perform an action based on the determining.

By determining that the hair contact member 225 is at the first end of the tress (e.g. the hair-root end of the tress), the start of the pass is detected. Similarly, by determining that the hair contact member 225 is at the second end of the tress (e.g. the hair-tip end of the tress), the end of the pass is detected. As such, the boundaries of the pass (namely the start and end) are identified by the hairstyling device 100, and used to control the hairstyling device 100. This enables a finer and/or more intelligent control of the hairstyling device 100 compared to a case in which the boundaries of a pass are not identified.

The first end may be located at the hair-root or at an intermediate point on the tress. The second end may similarly be located at the hair-tip or at an intermediate point on the tress. In embodiments, the first end comprises the hair-root end of the tress, and the second end comprises the hair-tip end of the tress.

In embodiments, heating of the hair contact member 225 is controlled based on the determining performed in step 420. For example, where the hairstyling device 100 comprises the heating element 220, the heating element 220 may be controlled based on the determining performed in step 420. As such, the method 400 may comprise controlling the heating element 220 based on a determination that the hair contact member 225 is at the first end of the tress or at the second end of the tress. Other components and/or functions of the hairstyling device 100 may be controlled based on the determining performed in step 420 in alternative embodiments.

In embodiments, in response to determining that the hair contact member 225 is at the first (e.g. hair-root) end of the tress, an amount of energy used to heat the hair contact member 225 (e.g. an amount of energy applied to the heating element 220) is increased. In response to determining that the hair contact member 225 is at the second (e.g. hair-tip) end of the tress, an amount of energy used to heat the hair contact member 225 is decreased. Therefore, the amount of energy used to heat the hair contact member 225 may be increased at the start of the pass (thereby to cause heating of the hair in the tress), and may be decreased at the end of the pass (when heating of hair is no longer being performed). This reduces power consumption compared to a case in which a constant amount of energy is used to heat the hair contact member 225 throughout use of the hairstyling device 100. Controlling heating of the hair contact member 225 in this manner allows a predetermined temperature delivery profile (e.g. a temperature ramp) to be applied along the tress. In embodiments, the amount of energy used for heating the hair contact member 225 is increased at a predetermined rate as the hair contact member 225 moves along the tress. In alternative embodiments, the amount of energy used to heat the hair contact member 225 and/or the operating temperature of the hair contact member 225 is constant along the tress. In such alternative embodiments, the amount of energy used to heat the hair contact member 225 is decreased at the end of the pass (when it is determined that the hair contact member 225 is at the second end of the tress), thereby reducing power consumption.

In embodiments, the sensor output indicates a use characteristic of the hairstyling device 100. The use characteristic is indicative of current use of the hairstyling device 100. The use characteristic may be a time-varying characteristic. In embodiments, the use characteristic is indicative of movement of the hair contact member 225. In embodiments, the use characteristic comprises a speed of the hair contact member 225 (e.g. as the hair contact member 225 moves along the tress). As such, the determination that the hair contact member 225 is at the first end or the second end of the tress may be based on the speed of the hair contact member 225. For example, the speed of the hair contact member 225 may be lower at the ends of the tress compared to when the hair contact member 225 is moving along the tress. In embodiments, the use characteristic indicates whether or not the hair contact member 225 is in motion.

In embodiments, the use characteristic comprises a position of the hair contact member 225, e.g. a displacement from the first end of the tress. As such, the determination that the hair contact member 225 is at the first end or the second end of the tress may be based on a determined position of the hair contact member 225. This may be calculated, for example, based on signals received from the IMU 235. A first position may be associated with the first end of the tress, and a second position may be associated with the second end. The position(s) are defined as co-ordinates in three-dimensional space in some embodiments. In other embodiments, the position(s) are defined as one-dimensional values, e.g. as distances from a known or predetermined location.

In embodiments, the hair contact member 225 is moveable between an open configuration and a closed configuration. In such embodiments, the use characteristic indicates whether the hair contact member 225 is in the open configuration or the closed configuration. In embodiments, the sensor equipment 230 comprises a Hall effect sensor. As such, the determination that the hair contact member 225 is at the first end or the second end of the tress may be on the basis of movement between the open configuration and the closed configuration of the hair contact member 225. For example, the hair contact member 225 may move from the open configuration to the closed configuration when the hair contact member 225 is at the hair-root end of the tress (e.g. at the start of a pass), and move from the closed configuration to the open configuration when the hair contact member 225 is at the hair-tip end of the tress (e.g. at the end of a pass). The hairstyling device 100 can thus detect the start and/or end of a pass without the need for user input.

In embodiments, for example where the sensor equipment 230 comprises the IMU 235, the use characteristic is indicative of movement of the hair contact member 225. In some such embodiments, the sensor output is processed using a velocity and/or position estimation algorithm (e.g. comprising a Madgwick filter and/or a machine learning model). This is described in more detail with reference to FIG. 3 above.

In embodiments, the hair contact member 225 is determined to be moving away from the first end of the tress towards the second end of the tress. Such a determination may be performed on the basis of signals received from the IMU 235, for example. Heating of the hair contact member 225 may be controlled based on such a determination. For example, heating of the hair contact member 225 may be controlled to implement a predetermined heat delivery profile as the hair contact member 225 moves along the tress.

In embodiments, e.g. where the hairstyling device 100 does not comprise the heating element 220, heating of the hair contact member 225 may be controlled by applying energy to the hair contact member 225 directly.

Figure 5:
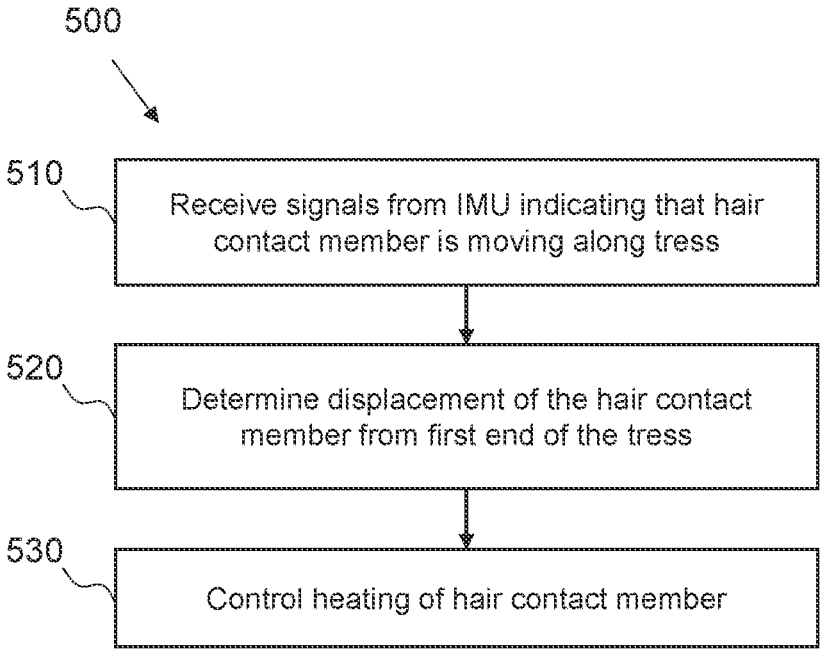
FIG. 5 is a flow diagram showing a method of operating a hairstyling device according to embodiments.

FIG. 5 shows a method 500 of operating a hairstyling device, according to embodiments. The method 500 may be used to operate the hairstyling device 100 described above with reference to FIGS. 1A, 1B and 2. In the embodiments of FIG. 5, the hairstyling device 100 comprises the heatable hair contact member 225 having a hair-contactable surface 116, 126. The hair contact member 225 is operable to apply heat to hair of a user via the hair-contactable surface. In these embodiments, the hairstyling device 100 also comprises the IMU 235. The IMU 235 is configured to output signals dependent on movement of the hair contact member 225. In embodiments, the method 500 is performed at least in part by the controller 210.

In step 510, one or more signals are received from the IMU 235, indicating that the hair contact member 225 is moving along a tress of hair from a first end of the tress to a second end of the tress.

In step 520, the received one or more signals are processed to determine a displacement of the hair contact member 225 from the first end of the tress.

In step 530, heating of the hair contact member 225 is controlled based on the determined displacement.

By controlling heating of the hair contact member 225 based on the determined displacement of the hair contact member 225 from the first end of the tress (e.g. the hair-root end of the tress), heat delivery and/or distribution along the tress can be controlled and/or adapted. As such, a target heat delivery profile along the tress can be achieved by determining the displacement of the hair contact member 225 at a given time, and controlling heating of the hair contact member 225 accordingly. In alternative embodiments, the received one or more signals are processed to determine a displacement of the hair contact member 225 from the second end of the tress (e.g. the hair-tip end of the tress).

In embodiments, the hairstyling device 100 comprises the heating element 220 operable to heat the hair contact member 225. In such embodiments, controlling heating of the hair contact member 225 comprises controlling the heating element 220.

In embodiments, the first end comprises the hair-root end of the tress, and the second end comprises the hair-tip end of the tress. The first end may be located at the hair-root or at an intermediate point on the tress. The second end may similarly be located at the hair-tip or at an intermediate point on the tress.

In embodiments, an amount of energy used to heat the hair contact member 225 (e.g. an amount of energy applied to the heating element 220) is adjusted based on the determined displacement. This allows a heat delivery profile which varies along the tress to be achieved. For example, the amount of energy used to heat the hair contact member 225 may be increased as the hair contact member 225 moves along the tress. As such, the amount of energy used to heat the hair contact member 225 may be dependent on the displacement of the hair contact member 225 from the first end of the tress. This enables a desired style to be achieved, whilst reducing styling time and reducing the likelihood of thermal damage to the hair.

In embodiments, heating of the hair contact member 225 is controlled based on a predetermined threshold operating temperature of the hair contact member 225. For example, heating of the hair contact member 225 may be controlled to keep the operating temperature of the hair contact member 225 above the predetermined threshold operating temperature. The predetermined threshold operating temperature is dependent on the determined displacement of the hair contact member 225 from the first end of the tress. For example, the predetermined threshold operating temperature may be lower when the hair contact member 225 is relatively close to the hair-root end, and may be higher when the hair contact member 225 is relatively far from the hair-root end (or close to the hair-tip end). Therefore, different operating temperatures of the hair contact member 225 may be used for different displacements. This enables a dynamic, or varying, heat delivery profile along the tress to be applied to the hair.

In embodiments, the one or more signals are processed to determine a length of the tress between the first end and the second end. The determined length may be used to determine the displacement of the hair contact member 225 from the first end. Determining the displacement using the length of the tress may be more accurate than a comparative case in which the tress length is not determined. Further, using the length of the tress enables relative displacements to be determined, in addition to or alternatively to absolute displacements. For example, at a given time it may be determined that the hair contact member 225 is halfway along the tress between the first end and the second end, and heating of the hair contact member 225 can be controlled accordingly (e.g. to apply predetermined heating to hair that is halfway between the first end and the second end). This enables desired heat delivery profiles to be implemented along the tress. In embodiments, absolute displacements are used to implement heat delivery profiles, e.g. using a predetermined tress length. This may be easier to implement live than a method in which the tress length is measured. A given section of the tress that is longer than the predetermined length may receive the maximum temperature of the heat delivery profile. In embodiments, the position of the hair contact member 225 relative to the user's head is determined, and used with a predetermined tress length to determine a displacement from the first end of the tress.

In embodiments, a first signal is received from the IMU 235 indicating that the hair contact member 225 is moving along the tress in a first pass. The first received signal is processed to determine a length of the tress. A second signal is then received from the IMU 235 indicating that the hair contact member 225 is moving along the tress in a second pass, subsequent to the first pass. The second signal is processed using the determined length to determine the displacement of the hair contact member 225 from the first end. Therefore, the length of the tress may be determined from IMU data on a first pass along the tress, and the determined length is then used on a second pass, along with IMU data, to determine the displacement along the tress at a given time. This may provide a more accurate value of the displacement than a comparative case in which the length of the tress is not previously determined. The first and the second pass may both be part of the same hairstyling session, or may be part of different hairstyling sessions. For example, the first pass may be from a previous hairstyling session. In alternative embodiments, both the tress length and the displacement are determined on the same pass. This involves fewer passes, and therefore less time and/or power consumption, than a case in which the tress length and displacement are determined on different passes.

In embodiments, heating of the hair contact member 225 is controlled to cause the operating temperature of the hair contact member 225 to increase as the hair contact member 225 moves along the tress from the hair-root end towards the hair-tip end. Providing a heat delivery profile that increases from the hair-root end towards the hair-tip end of the tress reduces the likelihood of thermal damage, whilst ensuring that sufficiently high temperatures are delivered to hair at the hair-tip end to achieve a desired style.

In embodiments, the received signals from the IMU 235 are processed using a Madgwick filter. This is described in more detail with reference to FIG. 3 above. In embodiments, the received signal is processed using a machine learning model, as described above.

In alternative embodiments, e.g. where the hairstyling device 100 does not comprise the heating element 220, heating of the hair contact member 225 may be controlled by applying energy to the hair contact member 225 directly.

Figure 6:
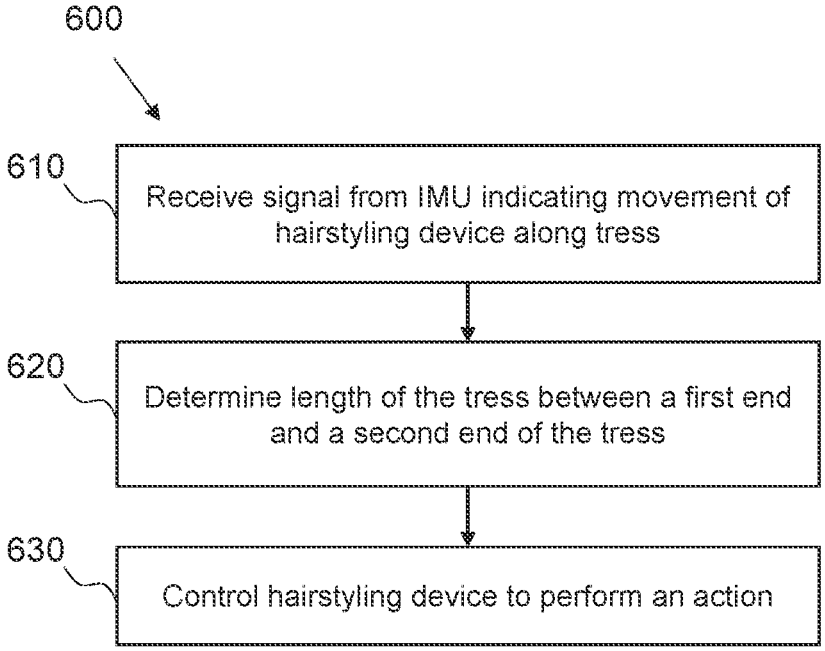
FIG. 6 is a flow diagram showing a method of operating a hairstyling device according to embodiments.

FIG. 6 shows a method 600 of operating a hairstyling device, according to embodiments. The method 600 may be used to operate the hairstyling device 100 described above with reference to FIGS. 1A, 1B and 2. In the embodiments of FIG. 6, the hairstyling device 100 comprises the IMU 235. The IMU 235 is configured to output signals dependent on movement of the hairstyling device 100. In embodiments, the method 600 is performed at least in part by the controller 210.

In step 610, a signal is received from the IMU 235, indicating movement of the hairstyling device 100 along a tress of hair between a first end of the tress and a second end of the tress.

In step 620, the received signal is processed to determine a length of the tress between the first end and the second end.

In step 630, the hairstyling device 100 is controlled to perform an action based on the determined length.

By determining the length of the tress, more useful information regarding the hair of the user can be obtained and utilised. For example, styling advice and/or feedback may be provided, e.g. via a user interface of the hairstyling device 100, in dependence on the tress length. Different styling advice may be appropriate for different tress lengths. Therefore, by determining the tress length from IMU data, the styling advice provided by the hairstyling device 100 can be tailored to a specific user. Additionally or alternatively, the determined tress length can be used to control one or more operating settings of the hairstyling device 100, e.g. an operating temperature, thereby enabling operational control to be tailored based on the tress length of the user.

In embodiments, the received signal is processed to determine a length between a hair-root end of the tress and a hair-tip end of the tress. The hairstyling device 100 may be controlled based on the determined length. The first end may be located at the hair-root or at an intermediate point on the tress. The second end may similarly be located at the hair-tip or at an intermediate point on the tress.

In embodiments, a displacement of the hairstyling device 100 from the first end of the tress is determined, using the determined length. The hairstyling device 100 may be controlled based on the determined displacement. Such a determined displacement may be more accurate than in a comparative case in which the displacement is not determined using the tress length. By more accurately determining the displacement of the hairstyling device 100 from the first end, greater control of a heating profile along the tress can be achieved. Determining the displacement of the hairstyling device 100 from the first end of the tress allows heat delivery and/or distribution along the tress to be controlled and/or adapted. As such, a target heat delivery profile along the tress can be achieved by determining the displacement of the hair contact member 225 at a given moment, and controlling the hairstyling device 100 accordingly.

In embodiments where the hairstyling device 100 comprises the heating element 220 operable to cause heat to be applied to hair of a user, the heating element 220 may be controlled based on the determined length. In embodiments where the hairstyling device 100 comprises the hair contact member 225, the heating element 220 may be controlled based on a target operating temperature of the hair contact member 225. The target operating temperature may be dependent on the determined length. As such, the hair may be heated differently by the hairstyling device 100 for tresses of different lengths. This allows the hairstyling device 100 to be tailored to the hair of the user, thereby reducing styling time and/or facilitating a desired style, compared to a case in which the operating temperature does not depend on the tress length.

In embodiments, a user interface is caused to provide an output relating to the determined length. In some embodiments, the user interface is comprised in the hairstyling device 100, e.g. the user interface 240. In alternative embodiments, the user interface is not comprised in the hairstyling device 100, for example the user interface may be comprised in a charging device for the hairstyling device or in an app installed on a mobile telephony device. The output may comprise an audio and/or visual output. In embodiments, the output comprises styling advice and/or feedback dependent on the determined length. For example, first styling advice may be provided if the determined length is below a predetermined threshold length, and second styling advice, different from the first styling advice, may be provided if the determined length is above the predetermined threshold length. As such, tailored feedback and/or advice can be provided to a user, thereby assisting the user in using the hairstyling device 100 in a more efficient and/or optimal manner.

In embodiments, based on the determined length, a section and/or layer of hair that is being styled using the hairstyling device 100 is determined. In such embodiments, the hairstyling device 100 is controlled in dependence on the determined section and/or layer of hair that is being styled. For example, specific styling advice and/or feedback may be provided to the user depending on which section and/or layer of hair is being styled. A crown section of the user's hair may have a different tress length compared to a nape section of the user's hair, and by determining which section is being styled, the hairstyling device 100 can be controlled differently (e.g. by providing tailored feedback via a user interface, and/or by controlling heating) for different sections.

In embodiments, the determined length is stored in a memory, e.g. the memory 250 of the hairstyling device 100. This allows the determined length to be retrieved and used at subsequent times, for example for subsequent passes and/or uses of the hairstyling device 100. In embodiments, the determined length is determined for a first pass along the tress, stored in the memory 250, and then used to determine a displacement of the hair contact member 225 moving along the tress in a second pass. In some embodiments, the determined length is stored for analysis of the user's hair. In embodiments, the determined length is stored to enable one or more settings of the hairstyling device 100 to be tailored to the hair of the user. For example, a user hairstyling profile may be generated for the user, based at least in part on the determined tress length. Such a user hairstyling profile may be used to provide feedback and/or advice to the user, and/or may be used to control one or more settings of the hairstyling device 100 during subsequent uses of the hairstyling device 100 by the user. In embodiments, the hairstyling device 100 is configured to generate and/or store multiple user hairstyling profiles for different users. That is, multiple users can each use the same hairstyling device 100, the different users having, for example, different lengths of hair, and the hairstyling device 100 can store tailored profiles for each user (either locally or remotely), to allow the settings of the hairstyling device 100 to adapt to the different users.

In embodiments, the received signal is processed using a Madgwick filter. This is described in more detail with reference to FIG. 3 above. In embodiments, the received signal is processed using a machine learning model, as described above.

Figure 7:
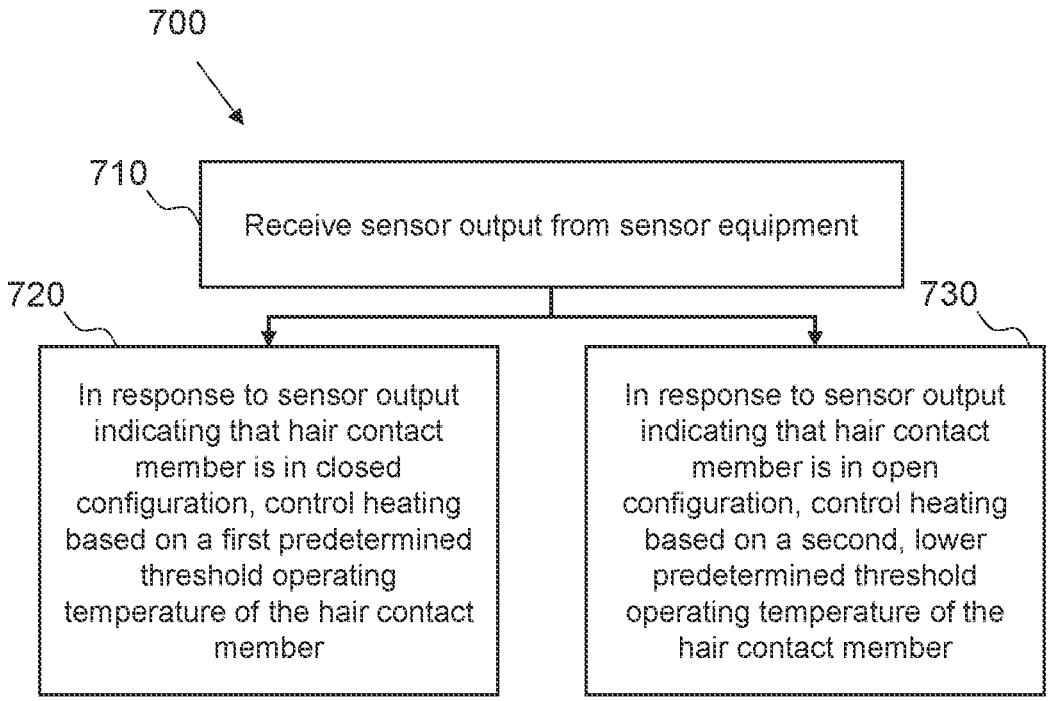
FIG. 7 is a flow diagram showing a method of operating a hairstyling device according to embodiments.

FIG. 7 shows a method 700 of operating a hairstyling device, according to embodiments. The method 700 may be used to operate the hairstyling device 100 described above with reference to FIGS. 1A, 1B and 2. In the embodiments of FIG. 7, the hairstyling device 100 comprises the heatable hair contact member 225. The hair contact member 225 comprises opposing first and second hair-contactable surfaces 116, 126. The hair contact member 225 is movable between a closed configured and an open configuration. The hairstyling device 100 comprises sensor equipment 230 configured to generate a sensor output indicating whether the hair contact member 225 is in the closed configuration or in the open configuration. In embodiments, the hairstyling device 100 comprises a cordless hairstyling device. In embodiments, the method 700 is performed at least in part by the controller 210.

In step 710, the sensor output is received from the sensor equipment 230.

In step 720, in response to the sensor output indicating that the hair contact member 225 is in the closed configuration, heating of the hair contact member 225 is controlled based on a first predetermined threshold operating temperature of the hair contact member 225.

In step 730, in response to the sensor output indicating that the hair contact member 225 is in the open configuration, heating of the hair contact member 225 is controlled based on a second predetermined threshold operating temperature of the hair contact member 225. The second predetermined threshold operating temperature is lower than the first predetermined threshold operating temperature.

As such, the operating temperature of the hair contact member 225 is caused to be lower when the hair contact member 225 is in the open configuration compared to when the hair contact member 225 is in the closed configuration. This allows for a reduction in power consumption, whilst maintaining the ability of the hair contact member 225 to deliver a desired amount of heat to hair.

When the hair contact member 225 is in the open configuration, the opposing first and second hair-contactable surfaces 116, 126 are spaced apart, and when the hair contact member 225 is in the closed configuration, the opposing first and second hair-contactable surfaces 116, 126 may be brought together. In embodiments, a distance between the first and second hair-contactable surfaces 116, 126 is less than a predetermined threshold distance when the hair contact member 225 is in the closed configuration, and is greater than the predetermined threshold distance when the hair contact member 225 is in the open configuration. In some cases, the first and second hair-contactable surfaces 116, 126 abut each other when the hair contact member 225 is in the closed configuration. In other cases, the first and second hair-contactable surfaces 116, 126 do not abut each other when the hair contact member 225 is in the closed configuration.

When the hair contact member 225 is in the closed configuration, hair engaged between the opposing first and second hair-contactable surfaces 116, 126 is styled, e.g. by application of heat and/or mechanical pressure. However, in embodiments, when the hair contact member 225 is in the open configuration, styling of hair does not occur. The hair contact member 225 may be in the open configuration when there is no hair between the opposing hair-contactable surfaces 116, 126, for example. In embodiments, the hair contact member 225 is in the open configuration when the hair contact member 225 is dormant, e.g. not in use. In embodiments, the hair contact member 225 is in the open configuration when the hairstyling device 100 is between passes. For example, a first pass along a tress of hair may be performed (with the hair contact member 225 in the closed configuration), and the hair contact member 225 may then be moved to the open configuration before a second pass along a tress of hair is started. Moving the hair contact member 225 to the open configuration may involve releasing hair that is engaged between the hair-contactable surfaces. Therefore, power consumption is reduced by lowering the threshold operating temperature when hair is not engaged between the hair-contactable surfaces.

In embodiments, the hairstyling device 100 comprises the heating element 220 operable to heat the hair contact member 225. In such embodiments, controlling heating of the hair contact member 225 comprises controlling the heating element 220.

In embodiments, in response to the sensor output indicating that the hair contact member 225 is in the closed configuration, heating of the hair contact member 225 is controlled to cause the operating temperature of the hair contact member 225 to stay above the first predetermined threshold operating temperature. In response to the sensor output indicating that the hair contact member 225 is in the open configuration, heating of the hair contact member 225 is controlled to cause the operating temperature of the hair contact member 225 to stay above the second predetermined threshold operating temperature.

In embodiments, in response to the sensor output indicating that the hair contact member 225 is in the closed configuration, energy is applied to heat the hair contact member 225 when the operating temperature of the hair contact member 225 falls below the first predetermined threshold operating temperature. In response to the sensor output indicating that the hair contact member 225 is in the open configuration, energy is applied to heat the hair contact member 225 when the operating temperature of the hair contact member 225 falls below the second predetermined threshold operating temperature.

In embodiments, in response to the sensor output indicating that the hair contact member 225 is in the closed configuration, a first amount of energy is applied to heat the hair contact member 225 (e.g. a first amount of energy is applied to the heating element 220). In response to the sensor output indicating that the hair contact member 225 is in the open configuration, a second amount of energy is applied to heat the hair contact member 225 (e.g. a second amount of energy is applied to the heating element 220). The second amount of energy is lower than the first amount of energy. As such, less energy may be applied to heat the hair contact member 225 when the hair contact member 225 is in the open configuration, thereby reducing power consumption.

In embodiments, the sensor equipment 230 comprises a Hall effect sensor. In some such embodiments, the hairstyling device 100 comprises a magnet coupled to the first hair-contactable surface 116, and the Hall effect sensor is coupled to the second hair-contactable surface 126. Sensor output generated by such a Hall effect sensor can be used to determine whether the hair contact member 225 is in the open or the closed configuration, e.g. whether a distance between the first and second hair-contactable surfaces 116, 126 is greater than or less than a predetermined threshold distance. In embodiments, the sensor equipment 230 comprises the IMU 235. As such, the determination of whether the hair contact member 225 is in the open configuration or the closed configuration may be based on sensed movement of the hair contact member 225.

In embodiments, the second predetermined threshold operating temperature is at least 50 degrees lower than the first predetermined threshold operating temperature.

In embodiments, e.g. where the hairstyling device 100 does not comprise the heating element 220, heating of the hair contact member 225 may be controlled by applying energy to the hair contact member 225 directly.

Figure 8:
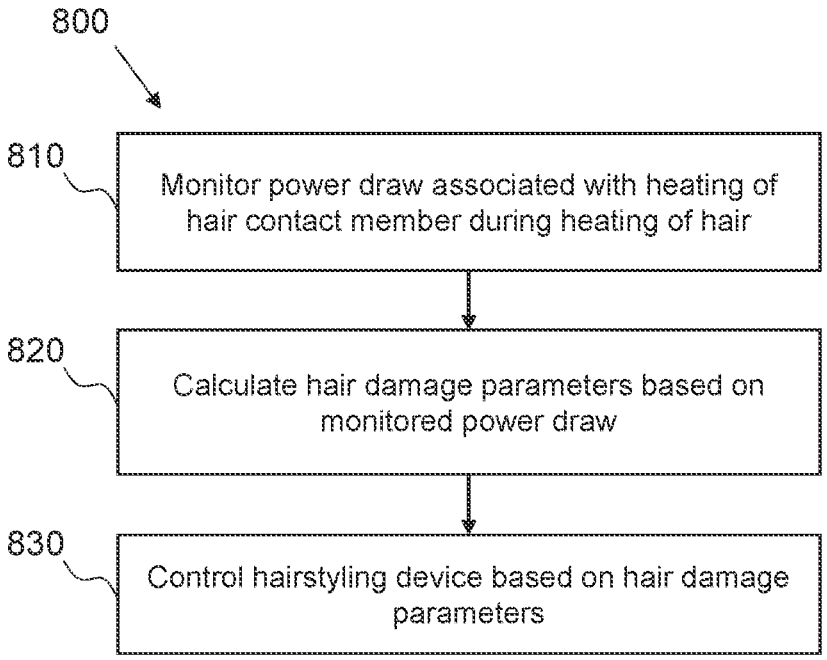
FIG. 8 is a flow diagram showing a method of operating a hairstyling device according to embodiments.

FIG. 8 shows a method 800 of operating a hairstyling device, according to embodiments. The method 800 may be used to operate the hairstyling device 100 described above with reference to FIGS. 1A, 1B and 2. In the embodiments of FIG. 8, the hairstyling device 100 comprises the heatable hair contact member 225 having a hair-contactable surface 116, 126. The hair contact member 225 is operable to apply heat to hair via the hair-contactable surface 116, 126. In embodiments, the method 800 is performed at least in part by the controller 210.

In step 810, power draw associated with heating of the hair contact member 225 during heating of hair of a user via the hair-contactable surface 116, 126 is monitored.

In step 820, based on the monitored power draw, one or more hair damage parameters are calculated, indicative of damage of the heated hair.

In step 830, the hairstyling device 100 is controlled based on the one or more calculated hair damage parameters.

In embodiments, the hairstyling device 100 comprises the heating element 220 operable to heat the hair contact member 225. In such embodiments, the one or more hair damage parameters are calculated based on monitored power drawn by the heating element 220 to heat the hair contact member 225. In alternative embodiments, e.g. where the hairstyling device 100 does not comprise the heating element 220, the one or more hair damage parameters are calculated based on monitored power drawn by the hair contact member 225 itself.

In embodiments, the one or more calculated hair damage parameters are indicative of at least one of physical damage, thermal damage and chemical damage of the heated hair.

In embodiments, the one or more calculated hair damage parameters are indicative of pre-existing damage of the heated hair. The hair may have previously suffered damage due to, for example, overheating (causing thermal damage), chemical treatment (causing chemical damage), too much clamping pressure applied and/or too many repeated passes (causing mechanical damage), etc. Therefore, pre-existing damage to the hair may be taken into account when controlling the hairstyling device 100. Controlling the hairstyling device 100 in view of the hair damage may involve, for example, controlling heating of the hair and/or providing feedback to the user, as will be described in more detail below.

Damaged hair may retain less moisture than undamaged hair, e.g. due to internal structural changes in the hair. The amount of moisture retained by the hair in turn affects the power draw associated with the hair contact member 225 in trying to heat the hair. Therefore, a measure of hair damage can be obtained by monitoring the power draw associated with the hair contact member 225 (e.g. the power drawn by the heating element 220) to heat the hair. For example, the power drawn by the heating element 220 to heat the hair to a given temperature may be relatively high for damaged hair (retaining less moisture), and may be relatively low for undamaged hair (retaining more moisture). The power draw may be measured using a power meter, ammeter, multimeter, etc. function incorporated into the hairstyling device.

In embodiments, the one or more calculated hair damage parameters are indicative of predicted damage due to the heating of the heated hair. In other words, the power draw associated with heating of the hair contact member 225 can be used to predict whether and/or to what extent the hair will be damaged due to the heating. Such damage may be in addition to pre-existing damage. As such, in embodiments, the one or more calculated hair damage parameters are indicative of both pre-existing damage and predicted damage to the heated hair. For example, if the hair is damaged such that less moisture is retained compared to undamaged hair, there may be an increased likelihood of further damage being done to the hair due to heating. By monitoring the power draw associated with heating the hair contact member 225 and determining the one or more hair damage parameters, such predicted future hair damage may be avoided. In alternative embodiments, the one or more hair damage parameters are indicative only of predicted damage (not of pre-existing damage).

In embodiments, the one or more hair damage parameters are indicative of a type of damage, e.g. chemical damage, thermal damage or mechanical damage. Such a type of damage may be determined based on the power draw associated with heating the hair contact member 225. For example, chemically damaged hair may retain less moisture than thermally damaged hair. In embodiments, the one or more hair damage parameters are indicative of an extent of hair damage. The one or more hair damage parameters may comprise values on an incremental scale, ranging from 0: 'undamaged' to 10: 'very damaged', for example.

In embodiments, the one or more hair damage parameters are calculated by monitoring power draw associated with heating of the hair contact member 225 to cause an operating temperature of the hair contact member 225 to stay above a predetermined threshold operating temperature. For example, the heating element 220 may draw more power to keep the operating temperature of the hair contact member 225 above the predetermined threshold for damaged hair compared to undamaged hair. The power drawn by the heating element 220 is indicative of the power draw associated with heating of the hair contact member 225 during heating of the hair.

In embodiments where the hairstyling device 100 comprises sensor equipment 230 configured to generate a sensor output dependent on movement of the hair contact member 225, the one or more hair damage parameters may be calculated based on the sensor output. The power drawn by the heating element 220 to heat the hair contact member 225 may be dependent on the movement of the hair contact member 225. Therefore, by taking the movement of the hair contact member 225 into account, the one or more hair damage parameters can be calculated more accurately from the monitored power.

In embodiments, the hair contact member 225 is operable to apply heat to the hair of the user by movement of the hair contact member 225 along a tress of hair between a hair-root end and a hair-tip end of the tress. A displacement of the hair contact member 225 may be determined, based on the sensor output. In such embodiments, the one or more hair damage parameters are calculated based on the determined displacement. The power draw associated with heating of the hair contact member 225 may be dependent on where the hair contact member 225 is in the tress, e.g. relative to the hair-root end or the hair-tip end. This is at least partly due to the tress typically being thicker at the hair-root end and thinner at the hair-tip end. Therefore, by taking the displacement of the hair contact member 225 from the hair-root end of the tress into account, the one or more hair damage parameters can be calculated more accurately from the monitored power.

In embodiments, it is determined, based on the sensor output, whether the hair contact member 225 is in motion. The one or more hair damage parameters may be calculated based on determining whether the hair contact member 225 is in motion. The power draw associated with heating the hair contact member 225 may be dependent on whether the hair contact member 225 is in motion. Therefore, by taking the movement of the hair contact member 225 into account, the one or more hair damage parameters can be calculated more accurately from the monitored power.

In embodiments, it is determined whether the heated hair has been heated previously by the hairstyling device 100. The one or more hair damage parameters may be calculated in dependence on whether the heated hair has been heated previously by the hairstyling device 100. The power draw associated with heating of the hair contact member 225 may be dependent on whether the heated hair has been heated previously by the hairstyling device 100. Therefore, by taking previous heating of the hair into account, the one or more hair damage parameters can be calculated more accurately from the monitored power. Previous heating of hair by the hairstyling device 100 may comprise heating during a previous hairstyling session, and/or heating during a previous pass within the current hairstyling session. Heating hair that has previously been heated may draw less power to the heating element 220 than heating hair that has not previously been heated. Further, heating hair that has previously been heated may increase a likelihood of thermal and/or mechanical damage being done to the hair.

In embodiments, it is determined whether the heated hair has been heated previously during a predetermined time period. The one or more hair damage parameters may be calculated in dependence on whether the heated hair has been heated previously during the predetermined time period. The predetermined time period may correspond to the current hairstyling session, for example. As such, the one or more hair damage parameters may be calculated in dependence on whether the heated hair has already been heated during the current hairstyling session.

In embodiments, a section and/or layer of the hair of the user that is being heated via the hair-contactable surface is determined. The one or more hair damage parameters may be calculated based on the determined section and/or layer of the hair. In embodiments, the section and/or layer that is being styled is determined using sensor data, e.g. IMU signals indicative of movement of the hair contact member 225. The power draw associated with heating of hair contact member 225 may be dependent on which section and/or layer of hair is being styled. Therefore, by taking the section and/or layer of hair into account, the one or more hair damage parameters can be calculated more accurately from the monitored power.

Hence, in embodiments, one or more factors which may affect the relationship between the power draw associated with heating the hair contact member 225 and the hair damage parameters are filtered out, or accounted for, in order to improve the accuracy of the calculation of the hair damage parameters. Such factors include the motion of the hair contact member 225, the displacement of the hair contact member 225 along the tress, whether and/or when the hair has previously been heated, and what section and/or layer of hair is being styled. Other factors may be determined and taken into account in alternative embodiments.

In embodiments, a user interface is caused to provide an output based on the one or more calculated hair damage parameters. The output may comprise a notification notifying the user that the hair being heated is damaged and/or is likely to become damaged. In embodiments, the notification notifies the user of the type of damage to the hair. In embodiments, the notification notifies the user of a location of the hair that is damaged and/or is likely to become damaged. For example, the user may be notified which section and/or layer of hair comprises damaged hair. In embodiments, the output comprises an alert relating to the hair damage parameters. In embodiments, the output comprises a notification notifying the user to take corrective action. For example, the notification may notify the user to cease heating the hair, in order to avoid damage/further damage being done to the hair. The notification may alternatively notify the user to adjust the operating temperature of the hair contact member 225 100, adjust the speed at which the user moves the hair contact member 225, and/or adjust the clamping pressure applied by the user to the hair.

The user interface may be comprised in the hairstyling device 100. For example, the user interface may comprise the user interface 240 described with reference to FIG. 2 above. In alternative embodiments, the user interface is not comprised in the hairstyling device 100. The user interface may be comprised in a remote device communicatively coupled (e.g. via wireless communications) to the hairstyling device 100. Such a remote device may comprise a user device or a docking station, for example.

In embodiments, heating of the hair contact member 225 is controlled based on the one or more calculated hair damage parameters. For example, where the hairstyling device comprises the heating element 220, the heating element 220 may be controlled based on the one or more calculated hair damage parameters. In embodiments, an amount of energy applied to the heating element 220 is adjusted based on the one or more calculated hair damage parameters. This can reduce and/or avoid damage and/or further damage being done to the hair. In embodiments, the operating temperature of the hair contact member 225 is reduced if it is determined that the hair is damaged. In alternative embodiments, the operating temperature of the hair contact member 225 is increased if it is determined that the hair is damaged. Damaged hair may require a greater amount of heat to style in a desired manner, for example. In embodiments, it may be determined that the extent and/or type of hair damage is such that the likelihood and/or effect of further damage is negligible. In some embodiments, heating of the hair contact member 225 (e.g. by the heating element 220) is prevented based on the one or more calculated hair damage parameters. As such, heating of the hair via the hair contact member 225 may be ceased, thereby to reduce and/or avoid damage and/or further damage to the hair.

In alternative embodiments, e.g. where the hairstyling device 100 does not comprise the heating element 220, heating of the hair contact member 225 may be controlled by applying energy to the hair contact member 225 directly. In such embodiments, the power draw associated with heating of the hair contact member 225 may be monitored directly (rather than by monitoring the power drawn by the heating element 220 to heat the hair contact member 225), and used to calculate the one or more hair damage parameters.

Figure 9:
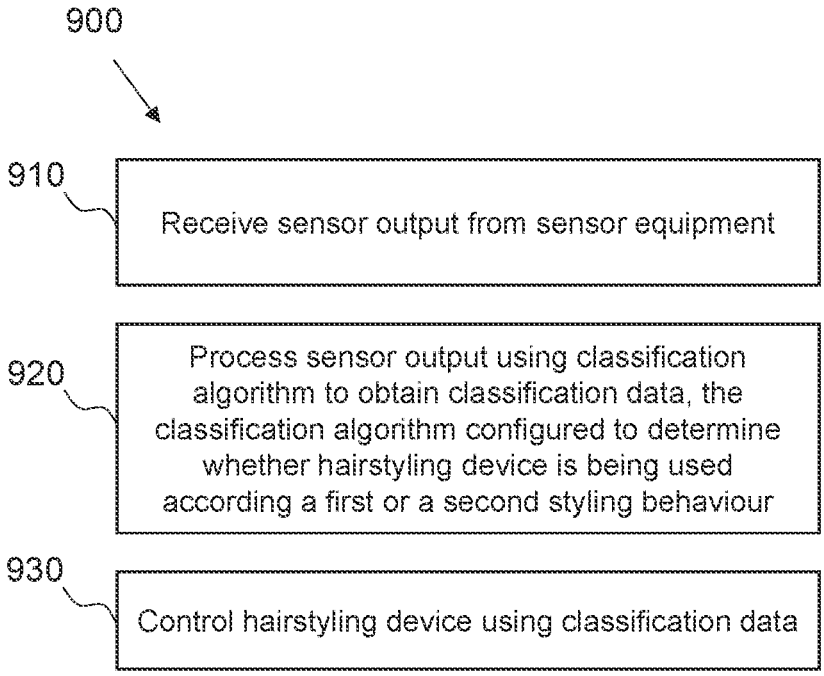
FIG. 9 is a flow diagram showing a method of operating a hairstyling device according to embodiments.

FIG. 9 shows a method 900 of operating a hairstyling device, according to embodiments. The method 900 may be used to operate the hairstyling device 100 described above with reference to FIGS. 1A, 1B and 2. In the embodiments of FIG. 9, the hairstyling device 100 comprises sensor equipment 230 configured to generate sensor output dependent on at least one use characteristic of the hairstyling device 100. The at least one use characteristic is indicative of current use of the hairstyling device 100. In embodiments, the method 900 is performed at least in part by the controller 210.

In step 910, the sensor output is received from the sensor equipment 230.

In step 920, the sensor output is processed using a classification algorithm to obtain classification data. The classification algorithm is configured to determine whether the hairstyling device 100 is being used according to a first styling behaviour or a second, different styling behaviour based on the at least one use characteristic of the hairstyling device 100.

In step 930, the hairstyling device 100 is controlled to perform an action using the classification data.

As such, the hairstyling device 100 is able to determine a styling behaviour that is currently being used, based on sensor data. By using the sensor data as an input to a classification algorithm, styling behaviours can be recognised without the need for user input. The hairstyling device 100 can therefore autonomously identify how the user is using the hairstyling device 100, and adapt itself accordingly. This allows for a more intelligent control of the hairstyling device 100. For example, one or more operating settings of the hairstyling device 100 can be controlled according to the identified behaviour. This allows the settings of the hairstyling device 100 to correspond more closely with how the user is trying to use the hairstyling device 100. This can reduce the styling time, and/or increase the likelihood that desired styles can be achieved. Further, this can reduce the likelihood of hair being damaged, e.g. by the user using incorrect and/or suboptimal settings for a given styling behaviour.

In embodiments, the first styling behaviour comprises a hair straightening behaviour, and the second styling behaviour comprises a non-straightening behaviour, e.g. a hair curling behaviour. The at least one use characteristic may be different for hair straightening compared to hair curling. For example, a user may move the hairstyling device 100 differently depending on whether the user is trying to straighten or curl hair. Hair curling involves a greater amount of rotation of the hairstyling device 100 compared to hair straightening, for example. As such, the classification algorithm may be configured to distinguish between hair straightening and hair curling using sensor data. In embodiments, it is determined that the hairstyling device 100 is not being used to straighten hair, and such a determination is used to infer that the hairstyling device 100 is being used to curl hair, or vice-versa. In embodiments, different operating settings of the hairstyling device 100 may be used depending on whether the hairstyling device 100 is determined as being used for hair straightening or non-hair straightening, e.g. hair curling. For example, it may be desired to use lower operating temperatures for hair curling compared to hair straightening, in order to achieve the desired style whilst reducing the likelihood of hair damage. This may be due to the pass duration being longer and/or the pass speed being slower for hair curling than for hair straightening. In embodiments, different heat delivery profiles may be determined and/or used depending on whether the hairstyling device 100 is determined as being used for hair straightening or hair curling.

In embodiments, the first styling behaviour comprises a full-style behaviour, and the second styling behaviour comprises a touch-up behaviour. The at least one use characteristic may be different for a full-style compared to a touch-up. For example, a user may move the hairstyling device 100 differently depending on whether the user is performing a full-style or a touch-up. A full-style may involve styling along the entire tress length, whereas a touch-up may involve styling only a part of the tress length (e.g. the tip-end of the tress). Additionally or alternatively, a full-style may involve styling the hair from scratch (e.g. where the hair has not been styled previously, or not styled previously during a predetermined time period), whereas a touch-up may involve modifying or restoring an existing style. As such, the classification algorithm may be configured to distinguish between a full-style and a touch-up using sensor data. In embodiments, different operating settings of the hairstyling device 100 may be used depending on whether the hairstyling device 100 is determined as being used for a full-style or a touch-up. For example, it may be desirable to use higher operating temperatures for a touch-up compared to a full-style. In embodiments, different heat delivery profiles may be determined and/or used depending on whether the hairstyling device 100 is determined as being used for a full-style or a touch up. For example, constant heat delivery profile may be used for a touch up, whereas a varying heat delivery profile may be used for a full-style.

In embodiments, the first styling behaviour comprises a wet hair styling behaviour, and the second styling behaviour comprises a dry hair styling behaviour. The at least one use characteristic may be different for wet hair compared to dry hair. For example, the power drawn by the hairstyling device 100 during use may depend on whether the hair is wet or dry. Whether the hair is wet or dry may be determined, for example, by using a capacitive sensor, a moisture sensor, and/or by monitoring the power draw during heating of the hair. As such, the classification algorithm may be configured to distinguish between wet hair styling and dry hair styling using sensor data. In embodiments, different operating settings of the hairstyling device 100 may be used depending on whether the hairstyling device 100 is determined as being used on wet hair or dry hair. In some cases, using the hairstyling device 100 on wet hair may increase a risk of damaging the hair compared to using the hairstyling device 100 on dry hair. In some such examples, a user interface may be caused to provide an output advising the user not to use the hairstyling device 100 on wet hair, in order to avoid damaging the hair. In other examples, one or more operating settings of the hairstyling device 100 may be adjusted depending on whether the hairstyling device 100 is determined as being used on wet hair or dry hair.

Other styling behaviours may be identified by the classification algorithm in alternative embodiments. For example, the classification algorithm may be configured to determine which section and/or layer of hair is being styled. In some examples, the classification algorithm is configured to determine whether the hairstyling device 100 is currently being used, is stationary due to being charging (e.g. is dormant), or is stationary due to the user moving between sections and/or layers of hair.

In embodiments, the classification algorithm comprises a trained algorithm. The classification algorithm is trained to determine whether the hairstyling device 100 is being used according to the first styling behaviour or the second styling behaviour using training data. Using such a trained algorithm results in a more accurate and/or reliable classification of styling behaviours compared to a case in which a trained algorithm is not used.

In embodiments, the classification algorithm comprises a machine learning algorithm. Such a machine learning algorithm may improve (e.g. increase accuracy and/or reliability of classification) through experience and/or training. In embodiments, the classification algorithm comprises a Random Forest algorithm. Such an algorithm may use a plurality of decision trees. The classification data may be obtained based on an average of the output classes of the individual trees. Other types of classification algorithm may be used in alternative embodiments. In embodiments, the classification algorithm comprises a first step of performing feature extraction on the sensor output, and a second step of performing behaviour classification using the extracted features. In embodiments, the machine learning algorithm comprises one or more artificial neural networks.

In embodiments, the hairstyling device 100 comprises a machine learning agent (not shown). The machine learning agent may be comprised in the controller 210, for example. In such embodiments, the machine learning agent comprises the classification algorithm. As such, the classification algorithm may be located on the hairstyling device 100. Performing the classification of styling behaviours on the hairstyling device 100 reduces latency compared to a case in which the classification algorithm is not located on the hairstyling device 100, since data is not required to be transmitted to and/or received from another device. This enables the classification data to be obtained more quickly, thereby reducing the time taken for any corrective action to be taken, e.g. adjusting one or more operating settings of the hairstyling device 100. This in turn may reduce the likelihood of damage being done to the hair, e.g. due to the operating settings not corresponding to the intended use of the hairstyling device 100.

In embodiments, for example where the sensor equipment 230 comprises the IMU 235, the at least one use characteristic is indicative of movement of the hairstyling device 100. As such, the styling behaviour may be determined based on how the hairstyling device 100 is being moved. In embodiments where the hairstyling device 100 comprises a hair contact member 225 comprising opposing first and second hair-contactable surfaces 116, 126, the hair contact member 225 being moveable between an open configuration and a closed configuration, the at least one use characteristic may be indicative of whether the hair contact member 225 is in the open configuration or in the closed configuration. The sensor equipment 230 may comprise a Hall effect sensor, for example, operable to sense whether the hair contact member 225 is in the open configuration or in the closed configuration. As such, the styling behaviour may be determined based on whether and/or when the hair contact member 225 is in the open and closed configurations.

In embodiments, the classification algorithm is modified using the sensor output. As such, the classification algorithm may be trained and/or further trained using the sensor output. Modifying the classification algorithm allows the accuracy and/or reliability of the algorithm to improve through experience and/or using more training data. That is, a confidence level of the classification data may be increased. Further, modifying the classification algorithm allows the classification algorithm to be tailored to the user. For example, an initial classification algorithm may be provided on the hairstyling device 100, but the initial classification algorithm does not take into account specific behaviours and/or activities of a given user. The user may move the hair contact member 225 in a particular manner, different from other users, for example. By using the sensor output as training data to dynamically re-train the classification algorithm, the classification algorithm can more reliably determine which styling behaviour the user is trying to use.

In embodiments where the hairstyling device 100 comprises the heating element 220 operable to cause heat to be applied to hair, the heating element 220 may be controlled based on the classification data. As such, the heating element 220 may be controlled in dependence on whether the hairstyling device 100 is being used according to the first styling behaviour or the second styling behaviour. In embodiments, the heating element 220 is controlled to apply a predetermined heat delivery profile along a tress of hair. The predetermined heat delivery profile is dependent on whether the hairstyling device 100 is being used according to the first styling behaviour or the second styling behaviour. In embodiments, controlling the heating element 220 comprises adjusting an amount of energy applied to the heating element 220 and/or adjusting an operating temperature of the hairstyling device 100. This enables the heat settings of the hairstyling device 100 to more closely correspond to the styling behaviour that the user intends to use. As such, a desired style can be achieved whilst reducing the likelihood of hair damage and/or reducing the styling time.

In embodiments, a user interface is caused to provide an output based on the classification data. The output may comprise, for example, a notification notifying the user that the current operating settings of the hairstyling device 100 do not correspond with the identified styling behaviour. This may prompt the user to take corrective action, e.g. to change the operating settings. In embodiments, the output comprises a warning against improper and/or unsafe use of the hairstyling device 100. In embodiments, the output comprises a request for the user to confirm that the identified styling behaviour is correct.

In embodiments, one or more contextual features are used as inputs to the classification algorithm to obtain the classification data. As such, the classification algorithm may take as inputs both the sensor output and the one or more contextual features. In embodiments, the one or more contextual features are indicative of previous uses of the hairstyling device. For example, it may be determined and/or known that the hairstyling device 100 was previously used by the user for hair straightening. This information influences the behaviour classification for subsequent uses. For example, a determined probability that the hairstyling device 100 is currently being used for hair straightening rather than hair curling may be increased due to the knowledge of the previous behaviour. In some embodiments, the previous uses comprise previously styled tresses within the same hairstyling session. For example, it may be determined and/or known that a first tress of hair is straightened using the hairstyling device 100. This information causes a determined probability that a second tress will also be straightened to be increased. In embodiments, the one or more contextual features are indicative of user preferences. Using contextual features as inputs to the classification algorithm increases the confidence level of the classification data.

In embodiments, the classification data is stored in a memory, e.g. the memory 250 of the hairstyling device 100. As such, the classification data may be used at a later time, for example during a subsequent use of the hairstyling device 100. In embodiments, the classification data is stored for use as a contextual feature during a subsequent use of the hairstyling device 100. This enables the confidence level for future classifications performed by the classification algorithm to be increased. In embodiments, the classification data is outputted for transmission to a remote device. For example, the classification data may be outputted for transmission to a user device. In embodiments, the classification data is used to generate a user hairstyling profile for the user. The user hairstyling profile may be used to provide tailored styling advice to the user, for example. The user hairstyling profile may be modified and/or updated as new classification data is obtained.

In embodiments, training data is received from a remote device. In some such embodiments, the classification algorithm is modified using the received training data. The training data may be received from a network, e.g. 'the Cloud'. Such training data may comprise sensor data and/or classification data associated with other users. Such training data may comprise crowd-sourced data, for example. In embodiments, such training data is greater in volume than sensor data and/or classification data obtained using the hairstyling device 100 directly. The use of the training data from the remote device to modify the classification algorithm can increase the accuracy and/or reliability of the classification algorithm compared to a case in which such training data is not used.

Figure 10:
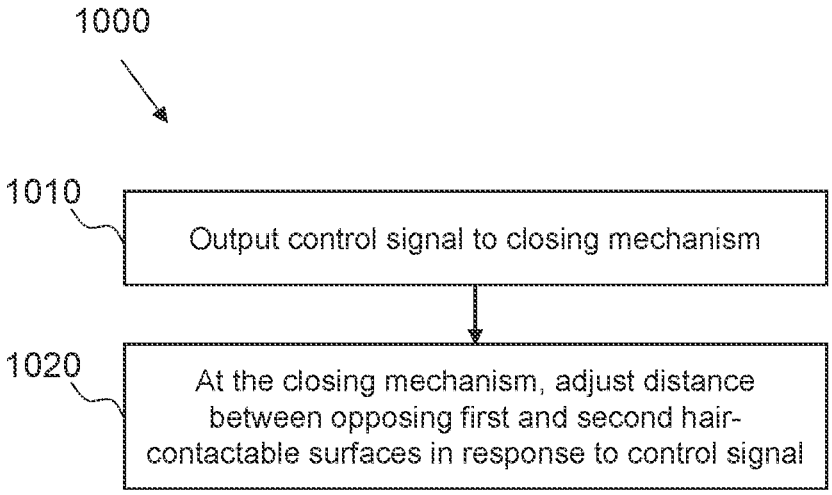
FIG. 10 is a flow diagram showing a method of operating a hairstyling device according to embodiments.

FIG. 10 shows a method 1000 of operating a hairstyling device, according to embodiments. The method 1000 may be used to operate the hairstyling device 100 described above with reference to FIGS. 1A, 1B and 2. In the embodiments of FIG. 10, the hairstyling device comprises the heatable hair contact member 225. The hair contact member 225 comprises the opposing first and second hair-contactable surfaces 116, 126. The hair contact member 225 is operable to apply heat to hair via at least one of the first hair-contactable surface 116 and the second hair-contactable surface 126. The hairstyling device 100 also comprises the closing mechanism 227 operable to move the first hair-contactable surface 116 relative to the second hair-contactable surface 126. In embodiments, the method 1000 is performed at least in part by the controller 210.

In step 1010, a control signal is outputted to the closing mechanism 227.

In step 1020, in response to receipt of the control signal, the closing mechanism 227 adjusts a distance between the first hair-contactable surface 116 and the second hair-contactable surface 126.

As such, the closing mechanism 227 is responsive to control signals, e.g. from the controller 210. Therefore, in embodiments, the user is not relied upon to control the distance between the first hair-contactable surface 116 and the second hair-contactable surface 126. This enables the clamping of hair between the hair-contactable surfaces 116, 126 to be performed in a more controlled and intelligent manner. If the user is relied upon to manually clamp the hair, too much or too little pressure may be applied to the hair. For example, at the hair-root end of a tress, where the hair between the hair-contactable surfaces 116, 126 is relatively thick, a user may apply too much clamping pressure, thereby risking damage to the hair. However, at the hair-tip end of the tress, where the hair between the hair-contactable surfaces 116, 126 is relatively thin, a user may be unable to apply sufficient clamping pressure to style the hair in a desired manner. Therefore, clamping the hair solely via a manual clamping force applied by a user may result in hair damage, an inability to achieve a desired style, and/or an increased styling time. Controlling the closing mechanism 227 in an automated manner, via control signals from the controller 210, thus reduces the likelihood of hair damage, increases the likelihood of a desired style being achieved and/or reduces styling time.

In embodiments, the hair contact member 225 comprises the first arm 110 and the second arm 120 movably coupled to the first arm 110, as described with reference to FIGS. 1A and 1B above. The first arm 110 comprises the first hair-contactable surface 116, and the second arm 120 comprises the second hair-contactable surface 126. In some such embodiments, the closing mechanism 227 is configured to, in response to receipt of the control signal, move the first hair-contactable surface 116 relative to the first arm 110. As such, the first arm 110 can move relative to the second arm 120, and the first hair-contactable surface 116 can additionally move relative to the first arm 110. In some such embodiments, closing of the hairstyling device 100 comprises two phases. In a first, manual, phase, a user moves the first arm 110 relative to the second arm 120, i.e. to move from an open configuration of the arms 110, 120 to a closed configuration of the arms 110, 120. In a second, automated, phase, the controller 210 causes the closing mechanism 227 to move the first hair-contactable surface 116 relative to the first arm 110, thereby to adjust a distance between the first and second hair-contactable surfaces 116, 126. In some embodiments, the closing mechanism 227 is configured to, in response to receipt of the control signal, move the first arm 110 relative to the second arm 120.

In embodiments, the closing mechanism 227 is operable to move the second hair-contactable surface 126 in addition to the first hair-contactable surface 116. This allows for a finer level of control compared to a case in which the closing mechanism 227 is operable to move only one of the hair-contactable surfaces 116, 126.

In embodiments, a target distance between the first hair-contactable surface 116 and the second hair-contactable surface 126 is identified. In such embodiments, the control signal is outputted to the closing mechanism 227 based on the target distance. The target distance may be identified based on a number of factors as described below.

In embodiments, a target clamping pressure to be applied to hair between the first and second hair-contactable surfaces 116, 126. In such embodiments, the control signal is outputted to the closing mechanism 227 based on the target clamping pressure. For example, the control signal may cause the closing mechanism 227 to apply the target clamping pressure to hair between the first and second hair-contactable surfaces 116, 126. The target clamping pressure may be identified based on a number of factors as described below.

In embodiments, the closing mechanism 227 is at least partly electro-mechanical. For example, the closing mechanism 227 may receive electrical control signals, and convert such control signals into mechanical movement. In embodiments, the closing mechanism 227 comprises one or more stepper motors. In such embodiments, the closing mechanism 227 is configured to, in response to receipt of the control signal, actuate the one or more stepper motors to move the first hair-contactable surface 116 relative to the second hair-contactable surface 126.

In embodiments, the closing mechanism 227 comprises one or more inflatable airbags adjacent to the first hair-contactable surface 116. In such embodiments, the closing mechanism 227 is configured to, in response to receipt of the control signal, control inflation of the one or more inflatable airbags to move the first hair-contactable surface 116 relative to the second hair-contactable surface 126. Such airbags may be used to provide a 'floating' plate 115 comprising the first hair-contactable surface 116, which can move relative to the first arm 110. Such airbags may be arranged behind the first hair-contactable surface 116, i.e. within the first arm 110. The closing mechanism 227 is configured to control inflation of the one or more airbags to a desired pressure. In embodiments, air is provided from a reservoir (e.g. a canister) under control of the controller 210. The desired pressure is dependent on a target distance between the first and second hair-contactable surfaces 116, 126 and/or a target pressure to be applied to hair between the first and second hair-contactable surfaces. The closing mechanism 227 may comprise a valve to prevent the desired pressure from being exceeded and/or to reduce the pressure in the one or more airbags. In embodiments, the closing mechanism 227 further comprises one or more inflatable airbags adjacent to the second hair-contactable surface 126, which may be controlled in a similar manner.

In embodiments, it is determined that the hair contact member 225 is moving along a tress of hair from a hair-root end of the tress towards a hair-tip end of the tress. For example, a signal from an IMU 235 may be received, indicating that the hair contact member 225 is moving along the tress. In some such embodiments, the control signal is outputted to the closing mechanism 227 in response to determining that the hair contact member 225 is moving along the tress. A target distance between the first and second hair-contactable plates 116, 126 and/or a target pressure to be applied to hair between the first and second hair-contactable plates 116, 126 may be dependent on movement of the hair contact member 225 along the tress.

In embodiments, the control signal is outputted to the closing mechanism based on a determined speed of the hair contact member 225 moving along the tress. For example, the clamping pressure may be reduced if the determined speed is above a predetermined threshold, in order to reduce the likelihood of mechanical damage being done to the hair.

In embodiments, a displacement of the hair contact member 225 from the hair-root end of the tress is determined. In such embodiments, the control signal is outputted to the closing mechanism 227 based on the determined displacement. The displacement may be determined using a signal from the IMU 235, for example. In embodiments, the displacement of the hair contact member 225 from the hair-root end is used to calculate a target distance between the first and second hair-contactable plates 116, 126 and/or a target pressure to be applied to hair between the first and second hair-contactable plates 116, 126. As such, the clamping pressure applied to hair may be controlled in a more intelligent manner.

In embodiments, the control signal is outputted to the closing mechanism 227 to cause the distance between the first hair-contactable surface 116 and the second hair-contactable surface 126 to decrease as the hair contact member 225 moves along the tress from the hair-root end of the tress towards the hair-tip end of the tress. Since hair is generally thicker at the hair-root end and thinner (and/or less healthy) at the hair-tip end, causing the distance between the hair contactable surfaces 116, 126 to decrease along the tress reduces the likelihood of damage to hair at the hair-root end, whilst ensuring that hair at the hair-tip end of the tress is styled in a desired manner.

In embodiments, the control signal is outputted to the closing mechanism 227 to cause a clamping pressure applied to hair between the first hair-contactable surface 116 and the second hair-contactable surface 126 to increase as the hair contact member 225 moves along the tress from the hair-root end of the tress towards the hair-tip end of the tress. As such, a pressure ramp may be applied to the tress of hair. Such a pressure ramp reduces the likelihood of damage to hair at the hair-root end of the tress, whilst ensuring that hair at the hair-tip end of the tress is styled in a desired manner. In embodiments, the pressure ramp (or 'pressure profile') is tailored to the user. For example, the pressure ramp may be determined based on one or more user preferences, previous uses of the hairstyling device 100, sensor data indicative of current use of the hairstyling device 100, etc.

In embodiments, a thickness of hair between the first and second hair-contactable surfaces 116, 126 is determined. In such embodiments, the control signal is outputted to the closing mechanism 227 based on the determined thickness of hair. The thickness may be determined, for example, by measuring the distance between the first and second hair-contactable surfaces 116, 126. In other examples, the thickness of hair is determined by measuring the power draw associated with heating of the hair contact member 225. For example, where the hairstyling device 100 comprises the heating element 220 configured to heat the hair, the thickness of hair may be determined by measuring the power drawn by the heating element 220 during heating. In embodiments, the thickness is determined based on the displacement of the hairstyling device 100 from the hair-root end of the tress. In embodiments, the determined thickness is used to calculate a target distance between the first and second hair-contactable plates 116, 126 and/or a target pressure to be applied to hair between the first and second hair-contactable plates 116, 126. In embodiments, the thickness of hair between the first and second hair-contactable plates is indicative of an amount of hair between the first and second hair-contactable plates 116, 126.

In embodiments, a distance between the first and second hair-contactable surfaces 116, 126 is determined. In such embodiments, the control signal is outputted to the closing mechanism 227 based on the measured distance. The distance between the first and second hair-contactable surfaces 116, 126 may be measured using a Hall effect sensor, for example. A target distance between the first and second hair-contactable plates 116, 126 and/or a target pressure to be applied to hair between the first and second hair-contactable plates 116, 126 may be dependent on the measured distance.

In embodiments, power draw associated with heating of the hair contact member 225 may be monitored during heating of hair via the at least one of the first hair-contactable surface 116 and the second hair-contactable surface 126. The power draw may be monitored using sensor equipment, e.g. a power meter. In examples where the hairstyling device 100 comprises the heating element 220, monitoring the power draw may comprise monitoring the power drawn by the heating element 220 during heating of the hair. Based on the monitored power draw, one or more hair damage parameters indicative of damage of the heated hair are calculated. In such embodiments, the control signal is outputted to the closing mechanism 227 based on the one or more calculated hair damage parameters. A target distance between the first and second hair-contactable plates 116, 126 and/or a target pressure to be applied to hair between the first and second hair-contactable plates 116, 126 may be dependent on the one or more calculated hair damage parameters. For example, the control signal may cause the clamping pressure to be reduced if the one or more calculated hair damage parameters indicate that damage to the hair is likely to occur (e.g. due to excessive clamping pressure). In some cases, the control signal may cause the clamping pressure to be increased if the one or more calculated hair damage parameters indicate that the hair is already damaged. This increased clamping pressure may facilitate styling of the damaged hair.

In embodiments, it is determined whether the hairstyling device 100 is being used according to a first styling behaviour (e.g. a hair straightening behaviour) or a second styling behaviour, different from the first styling behaviour (e.g. a hair curling behaviour). Such a determination may be made without user input, using a classification algorithm, for example, as described with reference to FIG. 9 above. In alternative embodiments, such a determination is made based on user input. In embodiments, the control signal is outputted to the closing mechanism 227 dependent on whether the hairstyling device 100 is being used according to the first styling behaviour or the second styling behaviour. A target distance between the first and second hair-contactable plates 116, 126 and/or a target pressure to be applied to hair between the first and second hair-contactable plates 116, 126 may be dependent on the determined styling behaviour. For example, the control signal may cause the clamping pressure to be different for hair straightening than for hair curling. This enables the different styles to be achieved, whilst reducing styling time and/or reducing the likelihood of hair damage.

In embodiments, the hairstyling device 100 is configured to prevent an external clamping force applied by a user from causing the distance between the first and second hair-contactable surfaces 116, 126 to go below a first predetermined threshold distance. In such embodiments, the control signal can cause the distance between the first and second hair-contactable surfaces 116, 126 to go below the first predetermined threshold distance, but the external clamping force applied by the user cannot. When the distance between the first and second hair-contactable surfaces 116, 126 is below the first predetermined threshold distance, the distance may be reduced further by the control signals but not by the external clamping force. As such, control of the distance between the hair-contactable surfaces 116, 126 may be performed by the user when the hair-contactable surfaces 116, 126 are relatively far apart (e.g. by moving the first arm 110 relative to the second arm 120), but may be performed solely by the controller 210 when the hair-contactable surfaces 116, 126 are relatively close together (e.g. by moving the first hair-contactable surface 116 relative to the first arm 110). This prevents the external force applied by the user from overriding the action of the control signals. In embodiments, the first predetermined threshold distance is approximately 2 millimetres.

In embodiments, it is determined that the distance between the first and second hair-contactable surfaces 116, 126 is less than a second predetermined threshold distance. The second predetermined threshold distance may be the same as or different from the first predetermined threshold distance. The control signal is outputted to the closing mechanism 227 in response to determining that the distance between the first and second hair-contactable surfaces 116, 126 is less than the second predetermined threshold distance. As such, the control of the closing mechanism 227 via the control signal is performed when the first and second hair-contactable surfaces 116, 126 are relatively close together. This ensures that the control of the closing mechanism 227 via the control signal is performed as and when appropriate, i.e. when hair is being styling by the hairstyling device 100. In embodiments where the arms 110, 120 are movable between an open configuration and a closed configuration, the control signal is outputted to the closing mechanism 227 in response to determining that the arms 110, 120 are in the closed configuration. In embodiments, if the arms 110, 120 are in the closed configuration but the hairstyling device is not actually in use (e.g. being held by the user and/or styling hair), the automated control of the closing mechanism 227 is not performed.

In embodiments, the distance between the hair-contactable surfaces 116, 126 when the arms 110, 120 are in the closed configuration and after the closing mechanism 227 has moved the first hair-contactable surface 116 is less than the distance between the hair-contactable surfaces 116, 126 when the arms 110, 120 are in the closed configuration before the closing mechanism 227 has moved the first hair-contactable surface 116. In other words, a 'manually closed position' is provided, in which the arms 110, 120 are in the closed position, and a separate 'automated closed position' is provided, in which the arms 110, 120 are in the closed position and additionally the closing mechanism 227 reduces the distance between the hair-contactable surfaces 116, 126 in response to the control signal. The automated closed position is thus 'more closed' than the manually closed position, in some embodiments.

In embodiments, the hairstyling device 100 is configured to prevent an external clamping force applied by a user from causing the first hair-contactable surface 116 to contact the second hair-contactable surface 126. For example, when the arms 110, 120 are in a closed configuration, the first and second hair-contactable surfaces 116, 126 may be spaced apart. In such embodiments, the control signal outputted to the closing mechanism 227 may cause the first and second hair-contactable surfaces 116, 126 to be brought into contact. As such, an external force applied by the user is prevented from overriding the action of the control signals in controlling the closing mechanism 227.

In embodiments, an external clamping force applied by a user to urge the first arm 110 towards the second arm 120 is determined, e.g. measured. Such an external clamping force may be determined using sensor output from sensor equipment (e.g. a force and/or pressure sensor). That is, the external clamping force may be measured by one or more sensors. The external clamping force is applied by the user to urge the first hair-contactable surface 116 towards the second hair-contactable surface 126. In embodiments, the control signal is outputted to the closing mechanism 227 based on the determined external clamping force. As such, the control of the closing mechanism 227, and consequently the distance between the hair-contactable surfaces 116, 126, may be dependent on the external clamping force applied by the user. Therefore, although the external clamping force applied by the user does not bring the first and second hair-contactable surfaces 116, 126 together directly, it can influence the control of the closing mechanism 227, via the control signal generated by the controller 210.

In embodiments, the control signal is outputted to the closing mechanism 227 in response to the measured external clamping force exceeding a predetermined threshold. As such, the closing mechanism 227 may be controlled by the controller 210 when the user tries to urge the hair-contactable surfaces 116, 126 together. In embodiments, the target clamping pressure to be applied by the closing mechanism 227 to hair between the hair-contactable surfaces 116, 126 is dependent on the measured external clamping force applied by the user. In other words, when the user tries to increase a clamping pressure (by increasing the force exerted on the arms 110, 120), such an increase is determined by the controller 210, which consequently increases the target clamping pressure to be applied by the closing mechanism 227.

In embodiments, the measured external clamping force is used to estimate a displacement of the hair contact member 225 along the tress. For example, a user may try to apply less force at the hair-root end of the tress and more force towards the hair-tip end of the tress, and this may be determined by the controller 210. In some examples, the measured external clamping force is used to determine a thickness of hair between the first and second hair-contactable surfaces 116, 126. For example, a user may try to apply more force when there is less hair and/or thinner hair between the hair-contactable surfaces 116, 126.

In embodiments where the hairstyling device 100 comprises sensor equipment 230 configured to generate a sensor output indicative of current use of the hairstyling device 100, the control signal may be outputted based on the sensor output. The sensor equipment 230 may comprise the IMU 235 and/or a Hall effect sensor, for example. As such, the closing mechanism 227 can be controlled based on the sensor output indicative of the current use of the hairstyling device 100, for example how the user is moving the hairstyling device 100. In embodiments, the sensor output is processed to determine one or more of: the speed of the hair contact member 225, the displacement of the hair contact member 225 from the hair-root end of the tress, the power draw associated with heating the hair contact member 225, whether the arms 110, 120 are in the open or closed configuration, the magnitude of an external clamping force applied by a user, a styling behaviour that is being used, the distance between the first and second hair-contactable surfaces 116, 126, and the thickness of hair between the first and second hair-contactable surfaces 116, 126. This enables the closing mechanism 227 to be controlled in a more intelligent and flexible manner.

Figure 11:
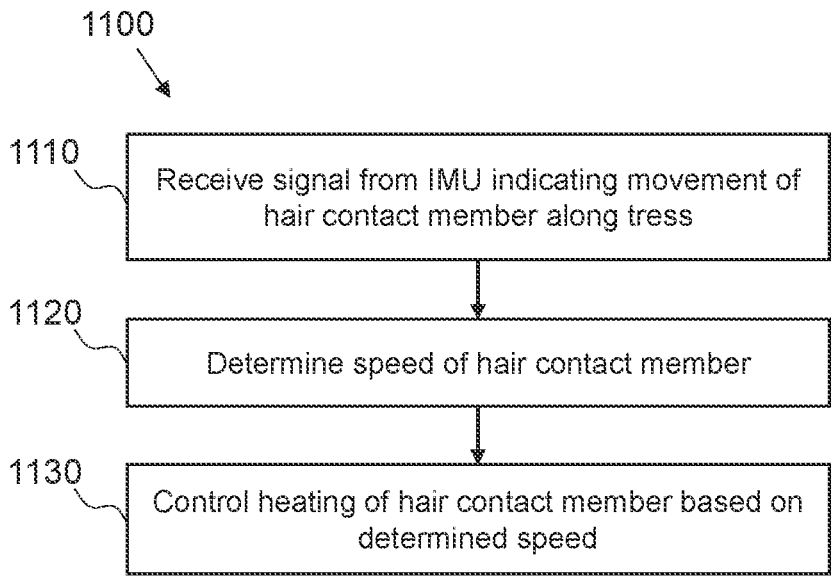
FIG. 11 is a flow diagram showing a method of operating a hairstyling device according to embodiments.

FIG. 11 shows a method 1100 of operating a hairstyling device, according to embodiments. The method 1100 may be used to operate the hairstyling device 100 described above with reference to FIGS. 1A, 1B and 2. In the embodiments of FIG. 11, the hairstyling device 100 comprises the heatable hair contact member 225 having a hair-contactable surface 116, 126. The hair contact member 225 is operable to apply heat to hair via the hair-contactable surface 116, 126. The hairstyling device 100 also comprises the IMU 235. The IMU 235 is configured to output signals dependent on movement of the hair contact member 225. In embodiments, the method 1100 is performed at least in part by the controller 210.

In step 1110, a signal is received from the IMU 235, indicating movement of the hair contact member 225 along a tress of hair between a first end of the tress and a second end of the tress.

In step 1120, the received signal is processed to determine a speed of the hair contact member 225.

In step 1130, heating of the hair contact member 225 is controlled based on the determined speed.

By controlling heating of the hair contact member 225 based on the determined speed of the hair contact member 225, heat delivery and/or distribution along the tress can be controlled and/or adapted in a more intelligent manner. Further, the determined speed may be used to predict whether damage to hair may occur, e.g. due to too much heat and/or mechanical pressure being applied to the hair. For example, if the hair contact member 225 is determined to be moving relatively slowly along the tress, the likelihood of thermal damage to the hair is increased. Heating of the hair contact member 225 may be controlled to reduce and/or avoid such damage. For example, heating of the hair contact member 225 may be controlled to reduce an amount of heat applied to the hair.

In embodiments, the first end of the tress comprises the hair-root end of the tress, and the second end of the tress comprises the hair-tip end of the tress. In such embodiments, the speed of the hair contact member 225 moving between the hair-root end and the hair-tip end is determined and used in the described manner. The first end may be located at the hair-root or at an intermediate point on the tress. The second end may be located at the hair-tip or at an intermediate point on the tress.

In embodiments, the hairstyling device 100 comprises the heating element 220 operable to heat the hair contact member 225. In such embodiments, controlling heating of the hair contact member 225 comprises controlling the heating element 220. As such, the heating element 220 may be controlled based on the determined speed.

In embodiments, a target heat delivery profile along the tress is determined, using the determined speed. In such embodiments, heating of the hair contact member 225 is controlled based on the target heat delivery profile. As such, a target heat delivery profile may be determined that is tailored to the user, based on how quickly the user moves the hair contact member 225 along the tress. Different target heat delivery profiles may be used for different speeds of the hair contact member 225. In embodiments, the target heat delivery profile comprises a heat delivery profile which varies along the tress. For example, the target heat delivery profile may comprise a temperature ramp along the tress. The steepness of the temperature ramp (i.e. the rate of temperature increase) along the tress may be dependent on the determined speed of the hair contact member 225. This allows the heat distribution along the tress to be controlled in an intelligent manner. In embodiments, a first target heat delivery profile is initially used by the hairstyling device 100. However, based on the determined speed of the hair contact member 225, a second, different target heat delivery profile is determined. The second target heat delivery profile may be able to achieve a desired style more quickly and/or with a reduced risk of damaging hair, compared to the first target heat delivery profile.

In embodiments, an amount of energy used to heat the hair contact member 225 (e.g. an amount of energy applied to the heating element 220) is adjusted based on the determined speed. For example, if it is determined that the speed of the hair contact member 225 is below a predetermined threshold speed, the amount of energy used to heat the hair contact member 225 may be reduced. This reduces the likelihood of thermal damage being done to the hair due to overheating. If it is determined that the speed is above a predetermined threshold speed, the amount of energy used to heat the hair contact member 225 may be increased. This ensures that sufficient heat is applied to the hair to achieve a desired style.

In embodiments, heating of the hair contact member 225 is controlled based on a target operating temperature of the hair contact member 225. The target operating temperature is dependent on the determined speed. For example, a relatively low target operating temperature may be used if the hair contact member 225 is being moved relatively slowly (thereby reducing the likelihood of thermal damage), whereas a relatively high target operating temperature may be used if the hair contact member 225 is being moved relatively quickly (thereby allowing sufficient heat to be transferred to the hair to achieve the desired style).

In embodiments, a displacement of the hair contact member 225 from the first end of the tress (e.g. the hair-root end) is determined on the basis of the determined speed. In such embodiments, heating of the hair contact member 225 is controlled based on the determined displacement from the first end. In embodiments, the displacement of the hair contact member 225 is determined using both a measurement of the length of the tress and the determined speed of the hair contact member 225. Such a determination may be more accurate than a comparative case in which the tress length and/or speed are not used to determine the displacement from the first end. By controlling heating of the hair contact member 225 based on the determined displacement, a finer control of the heat distribution along the tress can be achieved. For example, the operating temperature of the hair contact member 225 may be increased as the hair contact member 225 moves towards the hair-tip end. Providing a heat delivery profile that increases from the hair-root end towards the hair-tip end of the tress reduces the likelihood of thermal damage, whilst ensuring that sufficiently high temperatures are delivered to hair at the hair-tip end to achieve the desired style.

In embodiments, a user interface (e.g. the user interface 240 of the hairstyling device 100) is caused to provide an output based on the determined speed. In embodiments, the output comprises a notification notifying the user that the operating temperature of the hairstyling device 100 has been adjusted due to the speed of the hair contact member 225. In embodiments, the output comprises a notification advising the user to adjust the speed of the hair contact member 225.

In embodiments, received signals from the IMU 235 are processed using a velocity and/or position estimation algorithm (e.g. comprising a Madgwick filter). This is described in more detail with reference to FIG. 3 above. In embodiments, the received signal is processed using a machine learning model, as described above.

In embodiments, e.g. where the hairstyling device 100 does not comprise the heating element 220, heating of the hair contact member 225 may be controlled by applying energy to the hair contact member 225 directly. In either case, heating of the hair contact member 225 is controlled based on the determined speed.

Figure 12:
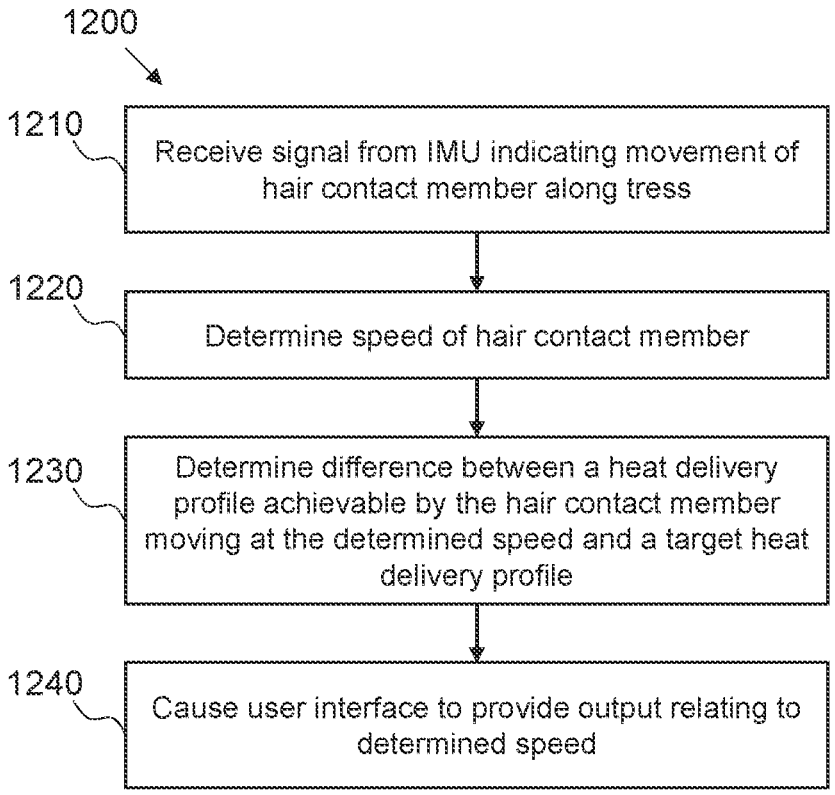
FIG. 12 is a flow diagram showing a method of operating a hairstyling device according to embodiments.

FIG. 12 shows a method 1200 of operating a hairstyling device, according to embodiments. The method 1200 may be used to operate the hairstyling device 100 described above with reference to FIGS. 1A, 1B and 2. In the embodiments of FIG. 12, the hairstyling device 100 comprises the heatable hair contact member 225 having a hair-contactable surface 116, 126. The hair contact member 225 is operable to apply heat to hair via the hair-contactable surface 116, 126. The hairstyling device 100 also comprises the IMU 235. The IMU 235 is configured to output signals dependent on movement of the hair contact member 225. In embodiments, the method 1200 is performed at least in part by the controller 210.

In step 1210, a signal is received from the IMU 235, indicating movement of the hair contact member 225 along a tress of hair of a user between a first end of the tress and a second end of the tress.

In step 1220, the received signal is processed to determine a speed of the hair contact member 225.

In step 1230, a difference is determined between a heat delivery profile achievable by the hair contact member 225 moving at the determined speed along the tress and a target heat delivery profile along the tress.

In step 1240, based on the determined difference, a user interface is caused to provide an output relating to the determined speed of the hair contact member 225.

By providing an output at a user interface based on a difference between a heat delivery profile achievable by the hair contact member 225 moving at the determined speed and a target heat delivery profile, the user may be notified that such a difference exists. That is, the user may be notified that the target heat delivery profile cannot be achieved due to the speed of the hair contact member 225.

In embodiments, the output provided by the user interface comprises a notification notifying the user to adjust the speed of the hair contact member 225. For example, the user may be prompted to speed up or slow down. Prompting the user to adjust the speed of the hair contact member 225 enables the hairstyling device 100 to achieve the target heat delivery profile. This increases the likelihood that the desired style can be achieved, whilst reducing the styling time and/or reducing the likelihood of hair damage.

In embodiments, the target heat delivery profile comprises a heat delivery profile which varies along the tress. That is, the target operating temperature of the hair contact member 225 may vary along the tress. For example, the target heat delivery profile may comprise a heat delivery profile which increases along the tress from the hair-root end towards the hair-tip end. Such a target heat delivery profile, when achieved, reduces the likelihood of hair damage at the hair-root end of the tress whilst ensuring that sufficient heat is applied to hair at the hair-tip end of the tress to achieve the desired style.

In embodiments, it is identified that the speed of the hair contact member 225 is outside of a target speed range. The target speed range defines speeds at which the hair contact member 225 can achieve the target heat delivery profile along the tress. For example, the speed of the hair contact member 225 may be below the target speed range (i.e. too slow), or may be above the target speed range (i.e. too fast). If the hair contact member 225 is determined to be moving too slowly and/or too quickly to achieve the target heat delivery profile, the user is informed via the user interface. The user may be prompted to adjust the speed of the hair contact member 225 such that the speed of the hair contact member 225 is within the target speed range. In embodiments, the target speed range is identified. Different target speed ranges may be associated with different target heat delivery profiles.

In embodiments, it is determined whether the hairstyling device 100 is being used according to a first styling behaviour or a second styling behaviour, different from the first styling behaviour. In such embodiments, the target heat delivery profile is dependent on whether the hairstyling device 100 is being used according to the first styling behaviour or the second styling behaviour. For example, a first target heat delivery profile may be used if the hairstyling device 100 is being used for hair straightening, and a second target heat delivery profile may be used if the hairstyling device 100 is being used for hair curling. In embodiments, the styling behaviour is determined using a classification algorithm, as described above. In alternative embodiments, the target heat delivery profile is not dependent on the styling behaviour being used.

In embodiments, determining whether the hairstyling device 100 is being used according to the first styling behaviour or the second styling behaviour is on the basis of a received signal from the IMU 235. As such, movement of the hair contact member 225 is used to identify the current styling behaviour of the hairstyling device 100. For example, hair curling may involve a greater amount of rotation of the hair contact member 225 compared to hair straightening. Such movement may be analysed using data from the IMU 235.

In embodiments, received signals from the IMU 235 are processed using a velocity and/or position estimation algorithm (e.g. comprising a Madgwick filter). This is described in more detail with reference to FIG. 3 above. In embodiments, the received signal is processed using a machine learning model, as described above.

In embodiments, the hairstyling device 100 comprises a user interface. For example, the output relating to the determined speed of the hair contact member 225 may be provided via the user interface 240 of the hairstyling device 100. This may increase the likelihood that the user will receive the output promptly compared to a case in which the user interface is not comprised in the hairstyling device 100. The output may comprise an audio output, a visual output, and/or a haptic output.

In embodiments, the user interface is comprised in a remote device, e.g. a mobile device or a docking station communicatively coupled to the hairstyling device 100. In such embodiments, a signal is outputted to the remote device to cause the user interface to provide the output. A user interface on such a remote device may be more versatile than a user interface on the hairstyling device 100 itself. For example, a larger display may be provided on the remote device than can be accommodated on the hairstyling device 100. Since the hairstyling device 100 is generally hand-held and has various other components, such as heating elements and hair-contactable surfaces, the amount of physical space on the hairstyling device 100 that is available for a user interface may be limited.

In embodiments, the method 1200 comprises determining the heat delivery profile achievable by the hair contact member 225 moving at the determined speed. In alternative embodiments, the heat delivery profile achievable by the hair contact member 225 is not determined. As such, the determining performed in step 1230 may comprise quantifying the difference between the achievable heat delivery profile and the target heat delivery profile, but alternatively may comprise merely identifying that a difference exists, i.e. that the target heat delivery profile cannot be achieved at the current speed.

In embodiments, the first end comprises the hair-root end of the tress, and the second end comprises the hair-tip end of the tress. As such, in embodiments, the signal received from the IMU 235 is indicative of movement of the hair contact member 225 between the hair-root end of the tress and the hair-tip end of the tress. In such embodiments, the speed of the hair contact member 225 moving between the hair-root end and hair-tip end of the tress is determined and used in the described manner.

Figure 13:
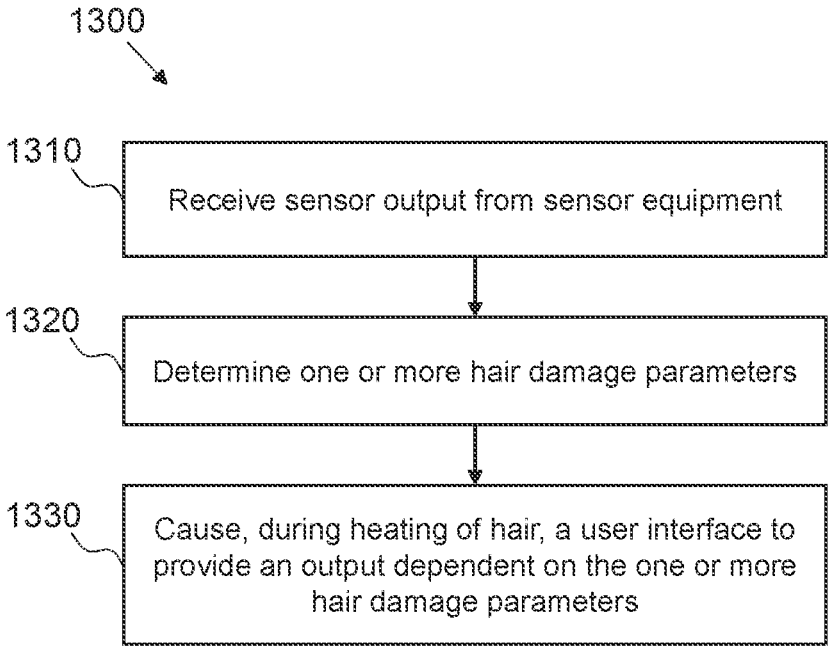
FIG. 13 is a flow diagram showing a method of operating a hairstyling device according to embodiments.

FIG. 13 shows a method 1300 of operating a hairstyling device, according to embodiments. The method 1300 may be used to operate the hairstyling device 100 described above with reference to FIGS. 1A, 1B and 2. In the embodiments of FIG. 13, the hairstyling device 100 comprises sensor equipment 230 configured to generate a sensor output dependent on at least one use characteristic of the hairstyling device 100 indicative of current use of the hairstyling device 100. In embodiments, the method 1300 is performed at least in part by the controller 210.

In step 1310, the sensor output is received from the sensor equipment 230.

In step 1320, the sensor output is processed to determine one or more hair damage parameters. The one or more hair damage parameters are indicative of damage to hair being heated by the hairstyling device 100.

In step 1330, a user interface is caused, during heating of the hair by the hairstyling device 100, to provide an output dependent on the one or more hair damage parameters.

By causing the user interface to provide the output during heating of the hair, rather than after the hairstyling session is complete, feedback can be provided in substantially real time. This allows the user to be informed that the hair which is currently being heated is damaged, or may become damaged. As such, more meaningful information may be conveyed to the user, and more promptly, compared to other methods. Further, such feedback can prompt the user to take corrective action, e.g. to change the speed and/or operating temperature of the hairstyling device 100, to reduce the likelihood of damage and/or further damage being done to the heated hair.

In embodiments, the one or more hair damage parameters are indicative of pre-existing damage to the hair. In embodiments, the one or more hair damage parameters are indicative of predicted damage due to the heating of the hair by the hairstyling device 100. In embodiments, the one or more hair damage parameters are indicative of both pre-existing damage and predicted damage. In embodiments, the one or more hair damage parameters are indicative of at least one of physical damage, thermal damage and chemical damage of the hair.

In embodiments, the output provided by the user interface comprises an audio, visual and/or haptic output. For example, the output may be provided via a display, a speaker and/or a haptic actuator.

In embodiments, the user interface is comprised in a remote device. A user interface on such a remote device may be more versatile than a user interface on the hairstyling device 100 itself. For example, a larger display may be provided on the remote device than can be accommodated on the hairstyling device 100. Since the hairstyling device 100 is generally hand-held and may have various other components, such as heating elements and hair-contactable surfaces, the amount of space on the hairstyling device 100 that is available for a user interface may be limited. In such embodiments, a signal is outputted to the remote device to cause the user interface to provide the output. Such a signal may be transmitted wirelessly, e.g. via Bluetooth™ technology, to the remote device.

In alternative embodiments, the hairstyling device 100 comprises the user interface. By providing the user interface on the hairstyling device 100, the output may be generated and received by the user more quickly compared to a case in which the user interface is not comprised on the hairstyling device 100, since the need for communications between different devices is avoided. Further, providing the user interface on the hairstyling device 100 may increase a likelihood that the user receives the feedback promptly. For example, the user may not be in the same location as the remote device during use of the hairstyling device 100, and therefore the user may not see/hear a notification on the remote device promptly.

In embodiments, the output provided by the user interface comprises a notification notifying the user that a feedback message is available on a remote device. In such embodiments, both the hairstyling device 100 and the remote device comprise user interfaces. However, the user interface on the remote device may be more versatile, complex and/or larger than the user interface on the hairstyling device 100. By notifying the user that a feedback message is available on the remote device, the user is prompted to look at the remote device (which may, in some cases, be in a different location to the user) to receive the feedback. The output provided on the hairstyling device 100 may comprise a flashing light, an audio tone and/or a vibration, for example. The feedback message on the remote device may comprise a text message, a pictographic message, an audio message, etc. In embodiments, the controller 210 of the hairstyling device 100 causes the remote device to provide the feedback message.

In embodiments, the output provided by the user interface comprises an alert relating to the one or more hair damage parameters. Such an alert may, for example, indicate that the part of the hair that is currently being heated is already damaged or is likely to become damaged due to the heating. In embodiments, the alert indicates a type of damage to the hair, e.g. chemical, thermal or mechanical damage.

In embodiments, the output provided by the user interface comprises a notification notifying the user to take corrective action. Such a notification may advise the user to adjust the speed of the hairstyling device 100 and/or the operating temperature of the hairstyling device 100, for example. In embodiments, the notification comprises a suggested operating temperature. By notifying the user to take corrective action in substantially real time, damage and/or further damage to the heated hair may be prevented.

In embodiments, one or more settings of the hairstyling device 100 are changed based on the one or more hair damage parameters. The one or more settings are changed by the hairstyling device 100 itself, e.g. by the controller 210. The one or more settings are changed to prevent damage and/or prevent further damage to the heated hair. In some such embodiments, the output provided by the user interface comprises a notification notifying the user that the one or more settings have been changed. As such, the hairstyling device 100 can autonomously change its settings based on the one or more hair damage parameters, before notifying the user that such changes have been made. This may be faster than a case in which the user is relied upon to change the settings of the hairstyling device 100, thereby reducing a likelihood of further damage to the hair. In embodiments, the one or more settings comprise an operating temperature of the hairstyling device 100. For example, the operating temperature may be reduced in order to prevent damage and/or further damage to the heated hair.

In embodiments, for example where the hairstyling device 100 comprises the IMU 235, the at least one use characteristic is indicative of movement of the hairstyling device 100. For example, the at least one use characteristic may be indicative of the speed of the hairstyling device 100. As such, the one or more hair damage parameters may be determined based on the speed of the hairstyling device 100. For example, if the speed of the hairstyling device 100 is determined to be above a predetermined threshold speed (i.e. moving too quickly), the one or more hair damage parameters may indicate a relatively high likelihood of mechanical damage being done to the hair. If the speed of the hairstyling device 100 is determined to be below a predetermined threshold speed (i.e. moving too slowly), the one or more hair damage parameters may indicate a relatively high likelihood of thermal damage being done to the hair. In embodiments, the at least one use characteristic is indicative of the displacement of the hairstyling device 100 along a tress of hair from a hair-root end of the tress. As such, the one or more hair damage parameters may be determined based on such a displacement.

In embodiments where the hairstyling device 100 comprises the hair contact member 225, the hair contact member 225 comprising opposing first and second hair-contactable surfaces, the hair contact member 225 being moveable between an open configuration and a closed configuration, the at least one use characteristic may be indicative of whether the hair contact member 225 is in the open configuration or in the closed configuration. As such, the one or more hair damage parameters may be determined based on whether the hair contact member 225 is in the open configuration or in the closed configuration. For example, the likelihood of mechanical and/or thermal damage being done to hair may increase if the hair contact member 225 is in the closed configuration for an extended period of time.

In embodiments, the sensor equipment 230 comprises a temperature sensor configured to sense an operating temperature of the hairstyling device 100 (e.g. an operating temperature of the hair contact member 225). In such embodiments, the at least one use characteristic comprises the operating temperature of the hairstyling device 100. As such, the one or more hair damage parameters may be determined based on the operating temperature of the hairstyling device 100. For example, if the operating temperature of the hairstyling device 100 is determined to be above a predetermined threshold (i.e. too hot), the likelihood of thermal damage being done to hair may increase.

In embodiments where the hairstyling device comprises the heating element 220, the sensor equipment 230 comprises a power sensor configured to sense power drawn by the heating element 220 during heating of hair. In such embodiments, the at least one use characteristic comprises the power drawn by the heating element 220. As such, the one or more hair damage parameters may be determined based on the power drawn by the heating element 220 during heating of the hair. As discussed above with reference to FIG. 8, a measure of hair damage can be obtained by monitoring the power draw associated with heating of the hair contact member 225 (e.g. the power drawn by the heating element 220) to heat the hair, due to the different moisture retention properties of damaged and undamaged hair. For example, the power drawn by the heating element 220 to heat the hair to a given temperature may be relatively high for damaged hair (retaining less moisture), and may be relatively low for undamaged hair (retaining more moisture). In alternative embodiments, e.g. where the hairstyling device 100 does not comprise the heating element 220, the power sensor may sense power drawn by the hair contact member 225 itself during heating of the hair.

The at least one use characteristic may comprise a combination of one or more of the factors described above. For example, the one or more hair damage parameters may be determined on the basis of a combination of the operating temperature and the speed of the hairstyling device 100.

It is to be understood that any feature described in relation to any one embodiment and/or aspect may be used alone, or in combination with other features described, and may also be used in combination with one or more features of any other of the embodiments and/or aspects, or any combination of any other of the embodiments and/or aspects. For example, it will be appreciated that features and/or steps described in relation to a given one of the methods 300, 400, 500, 600, 700, 800, 900, 1000, 1100, 1200, 1300 may be included instead of or in addition to features and/or steps described in relation to other ones of the methods 300, 400, 500, 600, 700, 800, 900, 1000, 1100, 1200, 1300.

In embodiments of the present disclosure, the hairstyling device 100 comprises a controller 210. The controller 210 is configured to perform various methods described herein. In embodiments, the controller comprises a processing system. Such a processing system may comprise one or more processors and/or memory. Each device, component, or function as described in relation to any of the examples described herein, for example the sensor equipment 230, user interface 240, and/or machine learning agent, may similarly comprise a processor or may be comprised in apparatus comprising a processor. One or more aspects of the embodiments described herein comprise processes performed by apparatus. In some examples, the apparatus comprises one or more processors configured to carry out these processes. In this regard, embodiments may be implemented at least in part by computer software stored in (non-transitory) memory and executable by the processor, or by hardware, or by a combination of tangibly stored software and hardware (and tangibly stored firmware). Embodiments also extend to computer programs, particularly computer programs on or in a carrier, adapted for putting the above described embodiments into practice. The program may be in the form of non-transitory source code, object code, or in any other non-transitory form suitable for use in the implementation of processes according to embodiments. The carrier may be any entity or device capable of carrying the program, such as a RAM, a ROM, or an optical memory device, etc.

The one or more processors of processing systems may comprise a central processing unit (CPU). The one or more processors may comprise a graphics processing unit (GPU). The one or more processors may comprise one or more of a field programmable gate array (FPGA), a programmable logic device (PLD), or a complex programmable logic device (CPLD). The one or more processors may comprise an application specific integrated circuit (ASIC). It will be appreciated by the skilled person that many other types of device, in addition to the examples provided, may be used to provide the one or more processors. The one or more processors may comprise multiple co-located processors or multiple disparately located processors. Operations performed by the one or more processors may be carried out by one or more of hardware, firmware, and software. It will be appreciated that processing systems may comprise more, fewer and/or different components from those described.

The techniques described herein may be implemented in software or hardware, or may be implemented using a combination of software and hardware. They may include configuring an apparatus to carry out and/or support any or all of techniques described herein. Although at least some aspects of the examples described herein with reference to the drawings comprise computer processes performed in processing systems or processors, examples described herein also extend to computer programs, for example computer programs on or in a carrier, adapted for putting the examples into practice. The carrier may be any entity or device capable of carrying the program. The carrier may comprise a computer readable storage media. Examples of tangible computer-readable storage media include, but are not limited to, an optical medium (e.g., CD-ROM, DVD-ROM or Blu-ray), flash memory card, floppy or hard disk or any other medium capable of storing computer-readable instructions such as firmware or microcode in at least one ROM or RAM or Programmable ROM (PROM) chips.

Where in the foregoing description, integers or elements are mentioned which have known, obvious or foreseeable equivalents, then such equivalents are herein incorporated as if individually set forth. Reference should be made to the claims for determining the true scope of the present disclosure, which should be construed so as to encompass any such equivalents. It will also be appreciated by the reader that integers or features of the present disclosure that are described as preferable, advantageous, convenient or the like are optional and do not limit the scope of the independent claims. Moreover, it is to be understood that such optional integers or features, whilst of possible benefit in some embodiments of the present disclosure, may not be desirable, and may therefore be absent, in other embodiments.

The invention claimed is:

1. A hairstyling device comprising:

a heatable hair contact member having a hair-contactable surface, the hair contact member being operable to apply heat to a tress of hair via the hair-contactable surface by movement of the hair contact member along the tress of hair between a first end of the tress and a second end of the tress;

sensor equipment configured to generate sensor output indicative of current use of the hairstyling device; and a controller configured to:

receive the sensor output from the sensor equipment;

determine, based on the sensor output indicative of current use, a first state in which the hair contact member is at the first end of the tress and a second state in which the hair contact member is at the second end of the tress; and control the heating of the heatable hair contact member to change an operating temperature of the hair contact member based on the determining.

2. The hairstyling device according to claim 1, wherein the first end of the tress comprises a hair-root end of the tress, and wherein the second end of the tress comprises a hair-tip end of the tress.

3. The hairstyling device according to claim 2, wherein the controller is configured to:

in response to determining that the hair contact member is at the hair-root end of the tress, decrease an amount of energy used to heat the hair contact member; and in response to determining that the hair contact member is at the hair-tip end of the tress, increase an amount of energy used to heat the hair contact member.

4. The hairstyling device according to claim 2, wherein the controller is configured to:

in response to determining that the hair contact member is at the hair-root end of the tress, cause the operating temperature of the hair contact member to decrease; and in response to determining that the hair contact member is at the hair-tip end of the tress, cause the operating temperature of the hair contact member to increase.

5. The hairstyling device according to claim 1, wherein the sensor output indicates a use characteristic of the hairstyling device.

6. The hairstyling device according to claim 5, wherein the use characteristic comprises a speed of the hair contact member.

7. The hairstyling device according to claim 5, wherein the use characteristic comprises a position of the hair contact member.

8. The hairstyling device according to claim 5, wherein the hair contact member is moveable between an open configuration and a closed configuration, and wherein the use characteristic indicates whether the hair contact member is in the open configuration or the closed configuration.

9. The hairstyling device according to claim 5, wherein the sensor equipment comprises an inertial measurement unit, IMU, and wherein the use characteristic is indicative of movement of the hair contact member.

10. The hairstyling device according to claim 9, wherein the controller is configured to process the sensor output using a velocity and/or position estimation algorithm.

11. The hairstyling device according to claim 10, wherein the velocity and/or position estimation algorithm comprises a Madgwick filter.

12. The hairstyling device according to claim 1, wherein the sensor equipment comprises a Hall effect sensor.

13. The hairstyling device according to claim 1, wherein the controller is configured to:

further determine, based on the sensor output, that the hair contact member is moving away from the first end of the tress towards the second end of the tress; and control heating of the hair contact member based on the further determining.

14. The hairstyling device according to claim 1, wherein the hairstyling device comprises a hair straightening device and/or a hair curling device.

15. A method of operating a hairstyling device, the hairstyling device comprising:

a heatable hair contact member having a hair-contactable surface, the hair contact member being operable to apply heat to a tress of hair via the hair-contactable surface by movement of the hair contact member along the tress of hair between a first end of the tress and a second end of the tress; and sensor equipment configured to generate sensor output indicating a use characteristic of the hairstyling device indicative of current use of the hairstyling device, the method comprising:

receiving the sensor output from the sensor equipment;

determining, based on the sensor output indicative of current use, a first state in which the hair contact member is at the first end of the tress and a second state in which the hair contact member is at the second end of the tress; and controlling the heating of the heatable hair contact member to change an operating temperature of the hair contact member to perform an action based on the determining.

16. A hairstyling device comprising:

a heatable hair contact member having a hair-contactable surface, the hair contact member being operable to apply heat to a tress of hair via the hair-contactable surface by movement of the hair contact member along the tress of hair between a first end of the tress and a second end of the tress;

sensor equipment configured to generate sensor output indicative of current use of the hairstyling device; and a controller configured to:

receive the sensor output from the sensor equipment;

determine, based on the sensor output, that the hair contact member is at the first end of the tress or the second end of the tress; and control the hairstyling device to perform an action based on the determining wherein the hair contact member is moveable between an open configuration and a closed configuration, and wherein the sensor output indicates a use characteristic of the hairstyling device, and the use characteristic comprises and indication of whether the hair contact member is in the open configuration or the closed configuration.

17. The hairstyling device according to claim 16, wherein the sensor equipment comprises a Hall effect sensor.

* * * * *